US007328659B2

(12) United States Patent
Forbes

(10) Patent No.: US 7,328,659 B2
(45) Date of Patent: Feb. 12, 2008

(54) RAIL ROAD FREIGHT CAR WITH RESILIENT SUSPENSION

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 11/189,092

(22) Filed: Jul. 25, 2005

(65) Prior Publication Data

US 2006/0016367 A1 Jan. 26, 2006

Related U.S. Application Data

(60) Continuation of application No. 10/703,790, filed on Nov. 6, 2003, now Pat. No. 6,920,828, which is a division of application No. 09/920,437, filed on Aug. 1, 2001, now Pat. No. 6,659,016.

(51) Int. Cl.
*B61F 5/00* (2006.01)

(52) U.S. Cl. ..... 105/198.2; 105/198.5

(58) Field of Classification Search ..... 105/182.1, 105/185, 189, 190.1, 190.2, 191, 192, 193, 105/197.05, 197.2, 198, 198.2, 198.4, 198.5, 105/200, 199.1, 201, 225, 199.3, 199.4, 413, 105/418, 419

See application file for complete search history.

(56) References Cited

U.S. PATENT DOCUMENTS 692,086 A 1/1902 Stephenson
895,157 A 8/1908 Bush
941,691 A * 11/1909 Anderson ..... 105/200
1,083,831 A 1/1914 Holdaway et al.
1,229,374 A 6/1917 Youngblood
1,316,553 A 9/1919 Barber
1,410,979 A * 3/1922 Westlake ..... 105/197.05
1,535,799 A 4/1925 Adams (Continued)

FOREIGN PATENT DOCUMENTS

AT 245610 3/1966

(Continued)

OTHER PUBLICATIONS

Photographs of experimental multi-unit articulated railroad flat car with short travel draft gear and reduced slack couplers developed by Canadian Pacific Railways, date unknown.

(Continued)

*Primary Examiner*—Mark T. Le
(74) *Attorney, Agent, or Firm*—Hahn Loeser & Parks LLP; Michael H. Minns

(57) ABSTRACT

An auto rack rail road freight car is provided for carrying low density, relatively high value, relatively fragile lading. The car has a relatively soft suspension and an empty vertical bounce natural frequency of less than 2.0 Hz. The car also has additional ballast to increase the dead sprung weight of the car relative to the weight of the lading. In the embodiments in which multi-unit articulated freight cars are employed, such as for auto rack rail cars, the ballast is located preferentially toward the coupler end trucks. The trucks for the rail car have an increased wheel base and damping located to provide a greater moment arm and bearing face to encourage a higher threshold for rail car hunting.

23 Claims, 14 Drawing Sheets

U.S. PATENT DOCUMENTS

| | | | | |
|---|---|---|---|---|
| 1,608,865 | A | | 11/1926 | Pehrson |
| 1,695,085 | A | | 12/1928 | Cardwell |
| 1,727,715 | A | * | 9/1929 | Kassler ..... 105/182.1 |
| 1,745,322 | A | | 1/1930 | Brittain, Jr. |
| 1,754,111 | A | | 4/1930 | Letshaw |
| 1,841,066 | A | | 1/1932 | Simning |
| 1,855,903 | A | | 4/1932 | Brittain, Jr. |
| 1,894,534 | A | | 1/1933 | Dolan |
| 1,902,823 | A | | 9/1933 | Bender |
| 1,953,103 | A | | 4/1934 | Buckwalter |
| 2,009,149 | A | | 7/1935 | Pierce |
| 2,009,771 | A | | 7/1935 | Goodwin |
| 2,053,990 | A | | 9/1936 | Goodwin |
| 2,129,408 | A | | 9/1938 | Davidson |
| 2,132,001 | A | | 10/1938 | Dean |
| 2,147,014 | A | | 2/1939 | Demarest |
| 2,155,615 | A | | 4/1939 | De L. Rice |
| 2,155,815 | A | | 4/1939 | Rice |
| 2,257,109 | A | | 9/1941 | Davidson |
| 2,324,267 | A | | 7/1943 | Oelkers |
| 2,333,921 | A | | 11/1943 | Flesch |
| 2,352,693 | A | | 7/1944 | Davidson |
| 2,367,510 | A | | 1/1945 | Light |
| 2,404,278 | A | | 7/1946 | Dath |
| 2,408,866 | A | | 10/1946 | Marquardt |
| 2,424,936 | A | | 7/1947 | Light |
| 2,432,228 | A | | 12/1947 | DeLano |
| 2,434,583 | A | | 1/1948 | Pierce |
| 2,434,838 | A | | 1/1948 | Cottrell |
| 2,446,506 | A | | 7/1948 | Barrett |
| 2,448,506 | A | | 8/1948 | Barrett et al. |
| 2,456,635 | A | | 12/1948 | Heater |
| 2,458,210 | A | | 1/1949 | Schlegel |
| 2,497,460 | A | | 2/1950 | Leese |
| 2,528,473 | A | | 10/1950 | Kowalik |
| 2,551,064 | A | | 5/1951 | Spenner |
| 2,570,159 | A | | 10/1951 | Schlegel |
| 2,613,075 | A | | 10/1952 | Barrett |
| 2,650,550 | A | | 9/1953 | Pierce |
| 2,659,318 | A | | 11/1953 | Steins et al. |
| 2,661,702 | A | | 12/1953 | Kowalik |
| 2,669,943 | A | | 2/1954 | Spenner |
| 2,687,100 | A | | 8/1954 | Dath |
| 2,688,938 | A | | 9/1954 | Kowalik |
| 2,693,152 | A | | 11/1954 | Bachman |
| 2,697,989 | A | | 12/1954 | Shafer |
| 2,717,558 | A | | 9/1955 | Shafer |
| 2,727,472 | A | | 12/1955 | Forssell |
| 2,737,907 | A | | 3/1956 | Janeway |
| 2,751,856 | A | | 6/1956 | Maatman |
| 2,762,317 | A | | 9/1956 | Palmgren |
| 2,777,400 | A | | 1/1957 | Forssell |
| 2,827,987 | A | | 3/1958 | Williams |
| 2,853,958 | A | | 9/1958 | Neumann |
| 2,865,306 | A | | 12/1958 | Bock et al. |
| 2,883,944 | A | | 4/1959 | Couch |
| 2,911,923 | A | | 11/1959 | Bachman et al. |
| 2,929,339 | A | | 3/1960 | Schueder et al. |
| 2,959,262 | A | | 11/1960 | Parker et al. |
| 3,017,840 | A | | 1/1962 | Fairweather |
| 3,024,743 | A | | 3/1962 | Williams et al. |
| 3,026,819 | A | | 3/1962 | Cope |
| 3,102,497 | A | | 9/1963 | Candlin et al. |
| 3,119,350 | A | | 1/1964 | Bellingher |
| 3,173,382 | A | | 3/1965 | Ryan |
| 3,205,836 | A | | 9/1965 | Wojcikowski |
| 3,218,990 | A | | 11/1965 | Weber |
| 3,221,669 | A | | 12/1965 | Baker et al. |
| 3,230,900 | A | | 1/1966 | Rupracht et al. |
| 3,240,167 | A | | 3/1966 | Podesta et al. |
| 3,274,955 | A | | 9/1966 | Thomas |
| 3,285,197 | A | | 11/1966 | Tack |
| 3,302,589 | A | | 2/1967 | Williams |
| 3,323,472 | A | | 6/1967 | Boone et al. |
| 3,358,614 | A | * | 12/1967 | Barber ..... 105/198.4 |
| 3,370,552 | A | | 2/1968 | Podesta et al. |
| 3,381,629 | A | | 5/1968 | Jones |
| 3,405,661 | A | | 10/1968 | Erickson et al. |
| 3,426,704 | A | | 2/1969 | Blunden |
| 3,461,814 | A | | 8/1969 | Weber et al. |
| 3,461,815 | A | | 8/1969 | Gedris et al. |
| 3,516,706 | A | | 6/1970 | Bruce |
| 3,547,049 | A | | 12/1970 | Sanders |
| 3,559,589 | A | | 2/1971 | Williams |
| 3,575,117 | A | | 4/1971 | Tack |
| 3,670,660 | A | | 6/1972 | Weber et al. |
| 3,678,863 | A | | 7/1972 | Pringle |
| 3,687,086 | A | | 8/1972 | Barber |
| 3,699,897 | A | | 10/1972 | Sherrick |
| 3,713,710 | A | * | 1/1973 | Wallace ..... 384/422 |
| 3,714,905 | A | | 2/1973 | Barber |
| 3,802,353 | A | | 4/1974 | Korpics |
| 3,834,320 | A | | 9/1974 | Tack |
| 3,844,226 | A | | 10/1974 | Brodeur et al. |
| 3,855,942 | A | | 12/1974 | Mulcahy |
| 3,857,341 | A | | 12/1974 | Neumann |
| 3,871,276 | A | | 3/1975 | Allen |
| 3,880,089 | A | | 4/1975 | Wallace |
| 3,897,736 | A | | 8/1975 | Tack |
| 3,901,163 | A | | 8/1975 | Neumann |
| 3,905,305 | A | | 9/1975 | Cope |
| 3,920,231 | A | | 11/1975 | Harrison et al. |
| 3,927,621 | A | | 12/1975 | Skeltis et al. |
| 3,965,825 | A | | 6/1976 | Sherrick |
| 3,977,332 | A | | 8/1976 | Bullock |
| 3,995,563 | A | | 12/1976 | Blunden |
| 3,995,720 | A | | 12/1976 | Wiebe |
| 4,003,318 | A | | 1/1977 | Bullock et al. |
| 4,034,681 | A | | 7/1977 | Neumann et al. |
| 4,067,261 | A | | 1/1978 | Scheffel |
| 4,072,112 | A | | 2/1978 | Wiebe |
| 4,078,501 | A | | 3/1978 | Neumann |
| 4,084,514 | A | | 4/1978 | Bullock |
| 4,103,623 | A | | 8/1978 | Radwill |
| 4,109,585 | A | | 8/1978 | Brose |
| 4,109,586 | A | | 8/1978 | Briggs et al. |
| 4,109,934 | A | | 8/1978 | Paton et al. |
| 4,111,131 | A | | 9/1978 | Bullock |
| 4,119,042 | A | | 10/1978 | Naves et al. |
| 4,119,043 | A | | 10/1978 | Naves et al. |
| 4,128,062 | A | | 12/1978 | Roberts |
| 4,148,469 | A | | 4/1979 | Geyer |
| 4,149,472 | A | | 4/1979 | Naves et al. |
| 4,151,801 | A | | 5/1979 | Scheffel et al. |
| 4,167,907 | A | | 9/1979 | Mulcahy et al. |
| 4,179,995 | A | | 12/1979 | Day |
| 4,186,914 | A | | 2/1980 | Radwill et al. |
| 4,191,107 | A | | 3/1980 | Ferris et al. |
| 4,192,240 | A | | 3/1980 | Korpics |
| 4,196,672 | A | | 4/1980 | Bullock |
| 4,230,047 | A | | 10/1980 | Wiebe |
| 4,233,909 | A | | 11/1980 | Adams et al. |
| 4,236,457 | A | | 12/1980 | Cope |
| 4,237,793 | A | | 12/1980 | Holden et al. |
| 4,239,007 | A | | 12/1980 | Kleykamp et al. |
| 4,242,966 | A | | 1/1981 | Holt et al. |
| 4,244,297 | A | | 1/1981 | Monselle |
| 4,254,712 | A | | 3/1981 | O'Neill |
| 4,254,713 | A | | 3/1981 | Clafford |
| 4,256,041 | A | | 3/1981 | Kemper et al. |
| 4,265,182 | A | | 5/1981 | Neff et al. |
| 4,274,339 | A | | 6/1981 | Cope |
| 4,274,340 | A | | 6/1981 | Neumann et al. |
| 4,276,833 | A | | 7/1981 | Bullock |

4,295,429 A 10/1981 Wiebe
4,311,098 A 1/1982 Irwin
4,316,417 A 2/1982 Martin
4,332,201 A 6/1982 Pollard et al.
4,333,403 A 6/1982 Tack et al.
4,336,758 A 6/1982 Radwill
RE31,008 E * 8/1982 Barber ..... 105/198.4
4,342,266 A 8/1982 Cooley
4,351,242 A 9/1982 Irwin
4,356,775 A 11/1982 Paton et al.
4,357,880 A 11/1982 Weber
4,363,276 A 12/1982 Neumann
4,363,278 A 12/1982 Mulcahy
4,370,933 A 2/1983 Mulcahy
4,373,446 A 2/1983 Cope
4,413,569 A 11/1983 Mulcahy
4,416,203 A 11/1983 Sherrick
4,426,934 A 1/1984 Geyer
4,434,720 A 3/1984 Mulcahy et al.
4,483,253 A 11/1984 List
RE31,784 E 1/1985 Wiebe
4,491,075 A 1/1985 Neumann
4,512,261 A 4/1985 Horger
4,526,109 A 7/1985 Dickhart et al.
4,537,138 A 8/1985 Bullock
RE31,988 E 9/1985 Wiebe
4,552,074 A 11/1985 Mulcahy et al.
4,554,875 A 11/1985 Schmitt et al.
4,574,708 A 3/1986 Solomon
4,590,864 A 5/1986 Przybylinski
4,637,319 A 1/1987 Moehling et al.
4,660,476 A 4/1987 Franz
4,671,714 A 6/1987 Bennett
4,674,411 A 6/1987 Schindehutte
4,674,412 A 6/1987 Mulcahy et al.
4,676,172 A 6/1987 Bullock
4,751,882 A 6/1988 Wheatley et al.
4,759,669 A 7/1988 Robertson et al.
4,765,251 A 8/1988 Guins
4,785,740 A 11/1988 Grandy
4,813,359 A 3/1989 Marulic et al.
4,825,775 A 5/1989 Stein et al.
4,825,776 A 5/1989 Spencer
4,870,914 A 10/1989 Radwill
4,915,031 A 4/1990 Wiebe
4,929,132 A 5/1990 Yeates et al.
4,936,226 A 6/1990 Wiebe
4,938,152 A 7/1990 List
4,942,824 A 7/1990 Cros
4,947,760 A 8/1990 Dawson et al.
4,953,471 A 9/1990 Wronkiewicz et al.
4,966,081 A 10/1990 Dominguez et al.
4,974,521 A 12/1990 Eungard
4,986,192 A 1/1991 Wiebe
5,000,097 A 3/1991 List
5,001,989 A 3/1991 Mulcahy et al.
5,009,521 A 4/1991 Wiebe
5,027,716 A 7/1991 Weber
5,046,431 A * 9/1991 Wagner ..... 105/198.4
5,072,673 A * 12/1991 Lienard ..... 105/198.2
5,081,935 A 1/1992 Pavlick
5,086,708 A 2/1992 McKeown, Jr. et al.
5,095,823 A 3/1992 McKeown, Jr.
5,107,773 A 4/1992 Daley et al.
5,111,753 A 5/1992 Zigler et al.
5,138,954 A 8/1992 Mulcahy
5,140,912 A 8/1992 Hesch
5,174,218 A 12/1992 List
5,176,083 A 1/1993 Bullock
5,226,369 A 7/1993 Weber
5,235,918 A 8/1993 Durand et al.
5,237,933 A 8/1993 Bucksbee
5,239,932 A 8/1993 Weber
5,241,913 A 9/1993 Weber
5,271,335 A 12/1993 Bogenschutz
5,271,511 A 12/1993 Daugherty, Jr. et al.
5,320,046 A 6/1994 Hesch
5,327,837 A 7/1994 Weber
5,331,902 A 7/1994 Hawthorne et al.
5,392,717 A 2/1995 Hesch et al.
5,404,826 A 4/1995 Rudibaugh et al.
5,410,968 A 5/1995 Hawthorne et al.
RE34,963 E 6/1995 Eungard
5,438,934 A 8/1995 Goding
5,450,799 A 9/1995 Goding
5,452,665 A 9/1995 Wronkiewicz et al.
5,463,964 A 11/1995 Long et al.
5,481,986 A 1/1996 Spencer et al.
5,503,084 A 4/1996 Goding et al.
5,509,358 A 4/1996 Hawthorne
5,511,489 A 4/1996 Bullock
5,511,491 A 4/1996 Hesch et al.
5,515,792 A 5/1996 Bullock et al.
5,524,551 A 6/1996 Hawthorne et al.
5,540,157 A 7/1996 Andersson et al.
5,544,591 A 8/1996 Taillon
5,555,817 A 9/1996 Taillon et al.
5,555,818 A 9/1996 Bullock
5,560,589 A 10/1996 Gran et al.
5,562,045 A 10/1996 Rudibaugh et al.
5,572,931 A 11/1996 Lazar
5,596,936 A 1/1997 Bullock et al.
5,613,445 A 3/1997 Rismiller
5,622,115 A 4/1997 Ehrlich et al.
5,632,208 A 5/1997 Weber
5,647,283 A 7/1997 McKisic
5,657,698 A 8/1997 Black, Jr. et al.
5,666,885 A 9/1997 Wike
5,685,228 A 11/1997 Ehrlich et al.
5,685,229 A 11/1997 O'hara et al.
5,690,033 A 11/1997 Andre
5,722,327 A 3/1998 Hawthorne et al.
5,735,216 A 4/1998 Bullock et al.
5,743,192 A 4/1998 Saxton et al.
5,746,137 A 5/1998 Hawthorne
5,749,301 A 5/1998 Wronkiewicz et al.
5,765,486 A 6/1998 Black, Jr. et al.
5,782,187 A 7/1998 Black, Jr. et al.
5,794,537 A 8/1998 Zaerr et al.
5,794,538 A 8/1998 Pitchford
5,799,582 A 9/1998 Rudibaugh et al.
5,802,982 A 9/1998 Weber
5,832,836 A 11/1998 Ehrlich et al.
5,845,584 A 12/1998 Bullock et al.
5,850,795 A 12/1998 Taillon
5,857,414 A 1/1999 Thoman et al.
5,875,721 A 3/1999 Wright et al.
5,918,547 A 7/1999 Bullock et al.
5,921,186 A 7/1999 Hawthorne et al.
5,924,366 A 7/1999 Trainer et al.
5,943,961 A 8/1999 Rudibaugh et al.
5,967,053 A 10/1999 Toussaint et al.
5,979,335 A 11/1999 Saxton et al.
5,992,330 A 11/1999 Gilbert et al.
6,125,767 A 10/2000 Hawthorne et al.
6,142,081 A 11/2000 Long
6,173,655 B1 1/2001 Hawthorne
6,178,894 B1 1/2001 Leingang
6,186,075 B1 2/2001 Spencer
6,196,134 B1 * 3/2001 Stecker ..... 105/226
6,227,122 B1 5/2001 Spencer
6,269,752 B1 8/2001 Taillon
6,276,283 B1 8/2001 Weber
6,283,040 B1 9/2001 Lewin
6,338,300 B1 1/2002 Landrot
6,347,588 B1 2/2002 Leingang

| | | | |
|---|---|---|---|
| 6,371,033 | B1 | 4/2002 | Smith |
| 6,374,749 | B1 | 4/2002 | Duncan et al. |
| 6,422,155 | B1 | 7/2002 | Heyden |
| 6,425,334 | B1 | 7/2002 | Wronkiewicz et al. |
| 6,591,759 | B2 | 7/2003 | Bullock |
| 6,631,685 | B2 | 10/2003 | Hewitt |
| 6,672,224 | B2 | 1/2004 | Weber et al. |
| 6,688,236 | B2 | 2/2004 | Taillon |
| 6,691,625 | B2 | 2/2004 | Duncan |
| 6,701,850 | B2 | 3/2004 | McCabe et al. |
| 2003/0024429 | A1 | 2/2003 | Forbes |
| 2003/0037696 | A1 | 2/2003 | Forbes |
| 2003/0041772 | A1 | 3/2003 | Forbes |
| 2003/0097955 | A1 | 5/2003 | Bullock |
| 2003/0129037 | A1 | 7/2003 | Forbes |

FOREIGN PATENT DOCUMENTS

| | | |
|---|---|---|
| CA | 714822 | 8/1965 |
| CA | 2090031 | 6/1991 |
| CA | 2153137 | 6/1995 |
| CA | 2191613 | 11/1996 |
| CA | 2034125 | 7/2000 |
| CA | 2100004 | 1/2004 |
| CH | 329987 | 5/1958 |
| CH | 371475 | 10/1963 |
| DE | 473036 | 2/1929 |
| DE | 664933 | 8/1938 |
| DE | 688777 | 2/1940 |
| DE | 1 180 392 | 10/1964 |
| DE | 2318369 | 10/1974 |
| EP | 0 264 731 | 4/1988 |
| EP | 347334 | 12/1989 |
| EP | 0 444 362 A2 | 9/1991 |
| EP | 494323 A | 7/1992 |
| EP | 1 053 925 | 11/2000 |
| FR | 1095600 | 6/1955 |
| GB | 2 045 188 | 10/1980 |
| IT | 324559 | 2/1935 |
| JP | 58-39558 | 3/1983 |
| JP | 63-279966 | 11/1988 |
| JP | 4-143161 | 5/1992 |
| WO | 00/13954 | 3/2000 |

OTHER PUBLICATIONS

1997 Car and Locomotive Cyclopedia, Simmons-Boardman Books, Inc. (Omaha), pp. 7-24, 6th ed., Section 1.

1997 Car and Locomotive Cyclopedia, Simmons-Boardman Books, Inc. (Omaha), pp. 705-770, 6th ed., Section 7.

1980 Car and Locomotive Cyclopedia, Simmons-Boardman Books, Inc. (Omaha), pp. 669-750, 4th ed., Section 13.

"Self-Aligning Spring Plankless Double Truss Trucks," 1937 Car and Locomotive Cyclopedia, Simmons-Boardman Publishing Corporation (New York), pp. 892-893.

"ASF Freight Car Trucks," 1966 Car and Locomotive Cyclopedia, Simmons-Boardman Publishing Corporation (New York), pp. 818-819.

"Barber Stabilized Truck," 1966 Car and Locomotive Cyclopedia, 1st ed., Simmons-Boardman Publishing Corporation (New York), p. 827.

1970 Car and Locomotive Cyclopedia, 2nd ed., Simmons-Boardman Publishing Corporation (New York), p. 816.

"For new directions in shock and motion protection, keep looking to Lord," 1974 Car and Locomotive Cyclopedia, 3rd ed., Simmons-Boardman Publishing Corporation (New York), pp. S13-S36, S13-S37.

1984 Car and Locomotive Cyclopedia, 5th ed., Simmons-Boardman Publishing Corporation (Omaha), pp. 512-513.

1984 Car and Locomotive Cyclopedia, 5th ed., Simmons-Boardman Publishing Corporation (Omaha), p. 488, 489, 496, 500 and 526.

1997 Car and Locomotive Cyclopedia, 6th ed., Simmons-Boardman Publishing Corporation (Omaha), p. 747.

"Section 7 Bearings," 1997 Car and Locomotive Cyclopedia, 6th ed., Simmons-Boardman Publishing Corporation (Omaha), pp. 811-822.

1997 Car and Locomotive Cyclopedia, 6th ed., Simmons-Boardman Publishing Corporation (Omaha), p. 834.

"Car Trucks: Freight, Modified Conventional," 1961 Car Builders Cyclopedia, 21st ed., Simmons-Boardman Publishing Corporation (New York), p. 846-847.

Nov. 1998 Railway Age, pp. 47, 51, 53 and 62.

"A Dynamic Relationship," Jul. 2003 Railway Age, pp. 37-38.

"Comprehensive Railroad Dictionary," Railway Age, Simmons-boardman Publishing Corporation, p. 142, no date.

Rownd, K. et al., "Improved Ride Quality for Transportation of Finished Automobiles by Rail," Sep. 1996, Technology Digest TD 96-021, Association of American Railroads.

Rownd, K. et al., "Over-the-Road Tests Demonstrate Improved Ride Quality for Transportation of Finished Automobiles," Sep. 1996, Technology Digest TD 96-022, Association of American Railroads.

Burnett, S. et al., "Improved Vehicle Dynamics Model for Tri-Level Auto-Rack Railcars," Sep. 1997, Technology Digest TD 97-038, Association of American Railroads.

Rownd, K. et al., "Improved Ride Quality for Rail Transport of Finished Automobiles," Sep. 1997, Technology Digest TD 97-039, Association of American Railroads.

Rownd, K. et al., "Use of Modified Suspensions to Improve Ride Quality in Bi-Level Auto-Racks," Jun. 1998, Technology Digest TD 98-014, Association of American Railroads.

Rownd, K. et al., "Improved Ride-Quality for Transportation of Finished Autos by Tri-Level Autorack," Oct. 1998, Technology Digest TD 98-025, Association of American Railroads.

Rownd, K. et al., "Advanced Suspensions Meet Performance Standards for Bi-Level Auto-Racks Cars," Dec. 1998, Technology Digest 98-032, Association of American Railroads.

Rownd, K. et al., "Advanced Suspensions Meet Ride-Quality Performance Standards for Tri-Level Auto-Racks Cars," Jun. 1999, Technology Digest TD 99-020, Association of American Railroads.

Rownd, K. et al., "Evaluation of End-of-Car Cushioning Designs Using the TOES Model," Jun. 1999, Technology Digest TD 99-019, Association of American Railroads.

Rownd, K. et al., "Improving the Economy of Bulk-Commodity Service Through Improved Suspensions," Aug. 1999, Technology Digest TD 99-027, Association of American Railroads.

Rownd, K. et al., "Improving the Economics of Bulk-Commodity Service: ASF Bulk Truck," Jul. 2000, Technology Digest TD 00-011, Association of American Railroads.

Rownd, K. et al., "Improving the Economics of Bulk-Commodity Service—S2E Standard Car Truck," Jul. 2000, Technology Digest TD 00-012, Association of American Railroads.

"ASF Trucks, Good for the Long Run," American Steel Foundries, date unknown.

"ASF User's Guide, Freight Car Truck Design," American Steel Foundries, ASF 652, date unknown.

"ADAPTERPlus," Pennsy Corporation, Internet—PENNSY.com, Ver. 9807, date unknown.

"Barber S-2-D Product Bulletin," undated.

"Roller Bearing Adapters for Freight Cars," Association of American Railroads Mechanical Division Manual of Standards and Recommended Practices Journal, Revised 1989, p. H-35 to H-42, date unknown.

"Narrow Pedestal Side Frame Trucks," Timken Roller Bearing Company, date unknown.

"Timken "AP" Bearing Assembly," Timken Roller Bearing Company, date unknown.

"Buckeye XC-R VII, Buckeye Steel Castings," date unknown.

"User's Manual for NUCARS, Version 2.0, SD-043," pp. 5-39 to 5-40, no date.

"Barber Change Brings Choices," Standard Car Truck Company, date unknown.

"Barber Friction Wedge Matrix," Standard Car Truck Company, date unknown.

"Barber Stabilized Truck—Suspension Performance Properties," Standard Car Truck Company, Mar. 14, 2000.
"Barber Stabilized Trucks presentation," Standard Car Truck Company, Oct. 10, 2000.
Standard Car Truck Company, Truck Information Package 2000: • Iron Friction Wedge Replacement Guide, Standard Car Truck Company, 2000. • Lifeguard Friction Wedge Replacement Guide, Standard Car Truck Company, 2000. • TwinGuard Friction Wedge Replacement Guide, Standard Car Truck Company, 2000. • Product Bulletin, Barber TwinGuard, Standard Car Truck Company, date unknown. • Barber Split Wedge, Standard Car Truck Company, date unknown. • Barber 905-SW Split Wedge Friction Casting, Standard Car Truck Company, 2000. • Barber 905-SW Split Wedge Pocket Insert, Standard Car Truck Company, 2000. Barber 905-SW Split Wedge Insert Application Guide, Standard Car Truck Company, 2000.

American Steel Foundries Information: • Super Service Ridemaster, American Steel Foundries, date unknown. • Motion Control M976 Upgrade Kit, source unknown, date unknown. • ASF Motion Control Truck System with Super Service Ridemaster & D5 Springs, drawing No. AR-3421, ASF-Keystone, Inc., Jul. 14, 2003. Assembly ASF/Pennsy Adapter Plus Pad & Adapter, drawing No. 43317, ASF-Keystone, Inc., Jul. 10, 2003.

* cited by examiner

Section at Main Bolster
Section Outboard of Main Bolster with Bolster Removed
℄ Railcar
TOR Half Side View
℄ Truck
Partial Section at Railcar ℄ with Springs Removed
TOR
56,58
58
77
X
424
425
422
423
426
405
406
404
400
402
408
50
350
38
56

RAIL ROAD FREIGHT CAR WITH RESILIENT SUSPENSION

This application is a continuation of U.S. patent application Ser. No. 10/703,790, filed Nov. 6, 2003, now U.S. Pat. No. 6,920,828, which is a divisional of U.S. patent application Ser. No. 09/920,437, filed Aug. 1, 2001, now U.S. Pat. No. 6,659,016.

FIELD OF THE INVENTION

This invention relates to the field of auto rack rail road cars for carrying motor vehicles.

BACKGROUND OF THE INVENTION

Auto rack rail road cars are used to transport automobiles. Most often, although not always, they are used to transport finished automobiles from a factory or a port to a distribution center. Typically, auto-rack rail road cars are loaded in the "circus loading" manner, by driving vehicles into the cars from one end, and securing them in places with chocks, chains or straps. When the trip is completed, the chocks are removed, and the cars are driven out.

Automobile manufacturers would like to be able to have new cars driven into the auto-rack cars, and then to be held in place using the parking brake of the car alone, without the need for chocks or chains. At present the operating characteristics of auto-rack cars are not generally considered to be gentle enough to permit this do be done reliably. That is, a long standing concern has been the frequency of damage claims arising from high accelerations imposed on the lading during train operation. It has been suggested that the maximum design load condition of some automobile components occurs during the single journey of the automobile on the rail car.

Damage due to dynamic loading in the rail car may tend to arise principally in two ways. First, there are the longitudinal input loads transmitted through the draft gear due to train line action or shunting. Second, there are vertical, rocking and transverse dynamic responses of the rail road car to track perturbations as transmitted through the rail car suspension.

In this context, slack includes (a) the free slack in the couplers; and (b) the travel of the draft gear of successive rail road cars under the varying buff and draft loads. Slack run-out occurs, for example, as a train climbs a long upgrade, and all of the slack is taken out of the couplings as the train stretches. Once the train clears the crest, and begins its descent, the rail road cars at the end of the train may tend to accelerate downhill into the cars in front, closing up the slack. This slack run-in and run-out can result in significant longitudinal accelerations. These accelerations are transmitted to the automobiles carried in the auto-rack cars.

Historically, the need for slack was related, at least in part, to the difficulty of using a steam locomotive to "lift" (that is, move from a standing start) a long string of cars with journal bearings, particularly in cold weather. Steam engines were reciprocating piston engines whose output torque at the drive wheels varied as a function of crank angle. By contrast, presently operating diesel-electric locomotives are capable of producing high tractive effort from a standing start, without concern about crank angle or wheel angle. For practical purposes, presently available diesel-electric locomotives are capable of lifting a unit train of one type of cars having little or no slack.

Switching is another process having a long history. Two common types of switching are "flat switching" and "humping". Humping involves running freight cars successively over a raised portion of track, and then allowing the car to run down-hill under gravity along various leads and sidings to couple with other cars as a train consist is assembled. For this type of operation the coupling speeds can be excessive, resulting in similarly excessive car body accelerations. For many types of rail road car, humping is now forbidden due to the probability of damaging the lading. An alternate form of switching is "flat switching" in which a locomotive is used to give a push to a rail road car, and then to send it rolling under its own inertia down a chosen siding to couple with another car. Particularly when done at night, the desirability of making sure that a good coupling is made tends to encourage rail yard personnel to make sure that the rail road cars are given an extra generous push. This often less than gentle habit tends to lead to rather high impact loads during coupling at impacts in the 5 m.p.h. (or higher) range. Forces can be particularly severe when there is an impact between a low density lading rail road car, such as an auto rack car, and a high density lading car (or string of cars) such as coal or grain cars.

Given this history, rail road car draft gear are designed to cope with slack run-out and slack run-in during train operation, and also to cope with the impact as cars are coupled together. Historically, common types of draft gear, such as that complying with, for example, AAR specification M-901-G, have been rated to withstand an impact at 5 m.p.h. (8 km/h) at a coupler force of 500,000 Lb. (roughly $2.2\times10^6$ N). Typically, these draft gear have a travel of 2¾ to 3¼ inches in buff before reaching the 500,000 Lb. load, and before "going solid". The term "going solid" refers to the point at which the draft gear exhibits a steep increase in resistance to further displacement. If the impact is large enough to make the draft gear "go solid" then the force transmitted, and the corresponding acceleration imposed on the lading, increases sharply. While this may be acceptable for coal or grain, it is undesirably severe for more sensitive lading, such as automobiles or auto parts, paper, and other high value consumer goods such as household appliances.

Consequently, from the relatively early days of the automobile industry, there has been a history of development of longer travel draft gear to provide lading protection for relatively high value, low density lading, in particular automobiles and auto parts, but also farm machinery, or tractors, or highway trailers. Draft gear development has tended to be directed toward providing longer travel on impact to reduce the peak acceleration. In the development of sliding sills, and latterly, hydraulic end of car cushioning (EOCC) units, the same impact is accommodated over 10, 15, or 18 inches of travel. As a result, for example, by the end of the 1960's nearly all auto rack cars, and other types of special freight cars had EOCC units. Further, of the approximately 45,000 auto-rack cars in service in 1997, virtually all were equipped with end of car cushioning units. A discussion of the developments of couplers, draft gear and EOCC equipment is given the 1997 Car and Locomotive Cyclopedia (Simmons-Boardman Books, Inc., Omaha, 1997 ISBN 0-911382-20-8) at pp. 640-702. In summary, there has been a long development of long travel draft gear equipment to protect relatively fragile lading from end impact loads.

In light of the foregoing, it is counter-intuitive to employ short-travel, or ultra short travel, draft gear for carrying wheeled vehicles. However, by eliminating, or reducing, the accumulation of slack, the use of short travel buff gear may tend to reduce the relative longitudinal motion between adjacent rail road cars, and may tend to reduce the associated velocity differentials and accelerations between cars. The use of short travel, or ultra-short travel, buff gear also has the advantage of eliminating the need for relatively expensive, and relatively complicated EOCC units, and the fittings required to accommodate them. This may tend to permit savings both at the time of manufacture, and savings in maintenance during service.

Further, as noted above, given the availability of locomotives that develop continuous high torque from a standing start, it is possible to re-examine the issue of slack action from basic principles. The use of vehicle carrying rail road cars in unit trains that will not be subject to operation with other types of freight cars, that will not be subject to flat switching, and that may not be subject to switching at all when loaded, provides an opportunity to adopt a short travel, reduced slack coupling system throughout the train. The conventional approach has been to adopt end of car equipment with sufficient travel to cope with existing slack accumulation between cars. In doing so, the long travel end of car equipment has tended to add to the range of slack action in the train that is to be accommodated by the draft gear along the train. The opposite approach is to avoid a large accumulation of slack in the first place. If a large amount of slack is not allowed to build up along the train, then the need for long-travel draft gear and other end of car equipment is also reduced, or, preferably, eliminated.

One way to reduce slack action is to use fewer couplings. To that end, since articulated connectors are slackless, use of articulated rail road cars significantly reduces the slack action in the train. Some releasable couplings are still necessary, to permit the composition of a train to change, if desired. Further, it is necessary to be able to change out a car for repair or maintenance when required.

To reduce overall slack, it would be advantageous to adopt a reduced slack, or slackless, coupler, (as compared to AAR Type E). Although reduced slack AAR Type F couplers have been known since the 1950's, and slackless "tightlock" AAR Type H couplers became an adopted standard type on passenger equipment in 1947, AAR Type E couplers are still predominant. AAR Type H couplers are expensive, (and are used for passenger cars), as were the alternate standard Type CS controlled slack couplers. According to the 1997 Cyclopedia, supra, at p. 647 "Although it was anticipated at one time that the F type coupler might replace the E as the standard freight car coupler, the additional cost of the coupler and its components, and of the car structure required to accommodate it, have led to its being used primarily for special applications". One "special application" for F type couplers is in tank cars, another is in rotary dump coal cars.

The difference between the nominal ⅜" slack of a Type F coupler and the nominal 25/32" slack of a Type E coupler may seem small in the context of EOCC equipped cars having 10, 15 or 18 inches of travel. By contrast, that difference, 13/32", seems proportionately larger when viewed in the context of the approximately 11/16" buff compression (at 700,000 lbs.) of Mini-BuffGear. It should be noted that there are many different styles of Type E and Type F couplers, whether short or long shank, whether having upper or lower shelves, as described in the Cyclopedia, supra. There is a Type E/F having a Type E coupler head and a Type F shank. There is a Type E50ARE knuckle which reduces slack from 25/32 to 20/32". Type F herein is intended to include all variants of the Type F series, and Type E herein is intended to include all variants of the Type E series having 20/32" of slack or more.

Another way to reduce slack action in the draft gear is to employ stiffer draft gear. Short travel draft gear are presently available. As noted above, most M-901-G draft gear have an official rating travel of 2¾" to 3¼" under a buff load of 500,000 Lbs. Mini-BuffGear, as produced by Miner Enterprises Inc., of 1200 State Street, Geneva Ill., appears to have a displacement of less than 0.7 inches at a buff load of over 700,000 lbs., and a dynamic load capacity of 1.25 million pounds at 1 inch travel. This is nearly an order of magnitude more stiff than some M-901-G draft gear. Miner indicates that this "special BuffGear gives drawbar equipped rail cars and trains improved lading protection and train handling", and further, "[The resilience of the Mini-BuffGear] reduces the tendency of the draw bar to bind while negotiating curves. At the same time, the Mini-BuffGear retains a high pre-load to reduce slack action. Elimination of slack between coupler heads, plus Mini-Buff Gear's high pre-load and limited travel, provide ultralow slack coupling for multiple-unit well cars and drawbar connected groups of unit train coal cars." Notably, unlike vehicle carrying rail cars, coal is unlikely to be damaged by the use of short travel draft gear.

In addition to M-901-G draft gear, and Mini-BuffGear, it is also possible to obtain draft gear having less than 1¾ inches of deflection at 400,000 Lbs., one type having about 1.6 inches of deflection at 400,000 Lbs. This is a significant difference from most M-901-G draft gear.

In terms of dynamic response through the trucks, there are a number of loading conditions to consider. First, there is a direct vertical response in the "vertical bounce" condition. This may typically arise when there is a track perturbation in both rails at the same point, such as at a level crossing or at a bridge or tunnel entrance where there may be a sharp discontinuity in track stiffness. A second "rocking" loading condition occurs when there are alternating track perturbations, typically such as used formerly to occur with staggered spacing of 39 ft rails. This phenomenon is less frequent given the widespread use of continuously welded rails, and the generally lower speeds, and hence lower dynamic forces, used for non-welded track. A third loading condition arises from elevational changes between the tracks, such as when entering curves in which case a truck may have a tendency to warp. A fourth loading condition arises from truck "hunting", typically at higher speeds, where the conicity of the wheels tends not only to give the trucks a measure of self-steering ability, but tends also to cause the truck to oscillate transversely between the rails. During hunting, the trucks tend most often to deform in a parallelogram manner. Lateral perturbations in the rails sometimes arise where the rails widen or narrow slightly, or one rail is more worn than another, and so on.

There are both geometric and historic factors to consider related to these loading conditions. One is the near universal usage of the three-piece style of freight car truck in North America. While other types of truck are known, such as an H-frame truck or single axle fixed truck as used in Europe, the three piece truck has advantages that have made it overwhelmingly dominant in freight service in North America. First, it can carry greater loads than a fixed, single axle truck, and permits greater longitudinal truck spacing than a single axle truck. The three piece truck is simple. It employs only three main component elements, namely a truck bolster and a pair of side frames. The side frame castings are inexpensive relative to alternative H-frame designs. Manufacture of the side frame requires a relatively small mold as compared to an H-frame truck, and may tend to be less prone to molding defects. The three piece truck relies on a primary suspension in the form of a set of springs trapped in a "basket" between the truck bolster and the side frames. The three piece truck can operate in a wide range of environmental conditions, over a long period of time, with relatively little maintenance. When maintenance is required, the springs and axles can be changed out relatively easily. In terms of wheel load equalisation, a three piece truck uses one set of springs and the side frames pivot about the truck bolster ends in a manner like a walking beam. By contrast, an H frame truck requires both a primary suspension and secondary suspension at each of the wheels. In summary, the 1980 *Car & Locomotive Cyclopedia*, states at page 669 that the three piece truck offers "interchangeability, structural reliability and low first cost but does so at the price of mediocre ride quality and high cost in terms of car and track maintenance". It would be desirable to retain many or all of these advantages while providing improved ride quality.

In terms of loading regimes, the first consideration is the natural frequency of the vertical bounce response. The static deflection from light car (empty) to maximum laded gross weight (full) of a rail car at the coupler must tend not to fall outside a given range, typically about 2 inches, if the couplers are to perform satisfactorily in interchange service. In addition, rail road car suspensions have a dynamic range in operation, including a reserve allowance.

In typical historical use, springs were chosen to suit the deflection under load of a full coal car, or a full grain car, or full loaded general purpose flat car. In each case, the design lading tended to be very heavy relative to the rail car weight. The live load for a 286,000 lbs., car may be of the order of five times the weight of the dead sprung load (i.e., the weight of the car including truck bolsters but less side frames, axles and wheels). Further, in these instances, the lading may not be particularly sensitive to abusive handling. That is, neither coal nor grain tends to be damaged badly by excessive vibration. In addition, coal and grain tend to have a relatively low value per unit weight. As a result these cars tend to have very stiff suspensions, with a dominant natural frequency in vertical bounce mode of about 2 Hz. when loaded, and about 4 to 6 Hz. when empty. Historically, much effort has been devoted to making freight cars light for two reasons. First, the weight to be back hauled empty is kept low, reducing the fuel cost of the backhaul. Second, when the ratio of lading to car weight increases, a higher proportion of hauling effort goes into hauling lading, as opposed to hauling the dead-weight of the railcars themselves.

By contrast, an autorack car has the opposite loading profile. A two unit articulated autorack car as presently in service may have a light car weight of 165,000 lbs., and a lading weight when fully loaded of only 35-40,000 lbs. The lading typically has a high, or very high, ratio of value to weight. Generally, while coal may account for as much as 40% of all car loadings, it may generate only about 25% of freight revenues. By comparison, automobiles may account for only about 2% of car loadings, yet may account for about 10% of freight revenues. Similarly, unlike coal or grain, automobiles are relatively fragile, and hence more sensitive to a gentle (or a not so gentle) ride. As a relatively fragile, high value, high revenue form of lading, it may be desirable to incur a greater expense to obtain superior ride quality to that suitable for coal or grain.

Historically auto rack cars were made by building a rack structure on top of a general purpose flat car. As such, the resultant car was sprung for the flat car design loads. This might yield a vertical bounce natural frequency in the range of 3 Hz. It would be preferable for the rail car vertical bounce natural frequency to be on the order of 1.4 Hz or less. Since this natural frequency varies as the square root of the quotient obtained by dividing the spring rate of the suspension by the overall sprung mass, it is desirable to reduce the spring constant, to increase the mass, or both.

Deliberately increasing the mass of any kind of freight car is, itself, counter intuitive, since many years of effort has gone into reducing the weight of rail cars relative to the weight of the lading for the reasons noted above. One manufacturer, for example, advertises a light weight aluminium auto-rack car. However, given the high value and low density of the lading, adding weight may be reasonable to obtain a desired level of ride quality. Further, auto rack rail cars tend to be tall, long, and thin, with the upper deck loads carried at a relatively high location as measured from top of rail. A significant addition of weight at a low height relative to top of rail may also be beneficial in reducing the height of the center of gravity of the loaded car.

Decreasing the spring rate involves further considerations. Historically the deck height of a flat car tended to be very closely related to the height of the upper flange of the center sill. This height was itself established by the height of the cap of the draft pocket. The size of the draft pocket was standardised on the basis of the coupler chosen, and the allowable heights for the coupler knuckle. The deck height usually worked out to about 40 or 41 inches above top of rail. For some time auto rack cars were designed to a 19 ft height limit. To maximise the internal loading space, it has been considered desirable to lower the main deck as far as possible, particularly in tri-level cars. Since the lading is relatively light, the trucks have tended to be light as well, such as 70 ton trucks, as opposed to 100, 110 or 125 ton trucks for coal, ore, or grain cars at 263,000, 286,000 or 315,000 lbs. Since the American Association of Railroads (AAR) specifies a minimum clearance of 5" above the wheels, the combination of low deck height, deck clearance, and minimum wheel height set an effective upper limit on the spring travel, and reserve spring travel range available. If softer springs are used, the remaining room for spring travel below the decks may well not be sufficient to provide the desired reserve height. In consequence, the present inventor proposes, contrary to lowering the main deck, that the main deck be higher than 42 inches to allow for more spring travel.

As noted above, many previous auto rack cars have been built to a 19 ft height. Another major trend in recent years has been the advent of "double stack" intermodal container cars capable of carrying two shipping containers stacked one above the other in a well or to other freight cars falling within the 20 ft 2 in. height limit of AAR plate F. Many main lines have track clearance profiles that can accommodate double stack cars. Consequently, it is now possible to use auto rack cars built to the higher profile of the double stack intermodal container cars. The present inventor has chosen to increase the height of the car generally to provide both a suitable internal height for the lading, and to permit the use of softer springs.

While decreasing the primary vertical bounce natural frequency appears to be advantageous for auto rack rail road cars generally, including single car unit rail road cars, articulated auto rack cars may also benefit not only from adding ballast, but from adding ballast preferentially to the end units near the coupler end trucks. As explained more fully in the description below, the interior trucks of articulated cars tend to be more heavily burdened than the end trucks, primarily because the interior trucks share loads from two adjacent car units, while the couple end trucks only carry loads from one end of one car. There are a number of reasons why it would be advantageous to even out this loading so that the trucks have roughly similar vertical bounce frequencies.

Three piece trucks currently in use tend to use friction dampers, sometimes assisted by hydraulic dampers such as can be mounted, for example, in the spring set. Friction damping has most typically been provided by using spring loaded blocks, or snubbers, mounted with the spring set, with the friction surface bearing against a mating friction surface of the columns of the side frames, or, if the snubber is mounted to the side frame, then the friction surface is mounted on the face of the truck bolster. There are a number of ways to do this. In some instances, as shown at p. 847 of the 1984 Car & Locomotive Cyclopedia lateral springs are housed in the end of the truck bolster, the lateral springs pushing horizontally outward on steel shoes that bear on the vertical faces of the side columns of the side frames. This provides roughly constant friction (subject to the wear of the friction faces), without regard to the degree of compression of the main springs of the suspension.

In another approach, as shown at p. 715 of the 1997 Car & Locomotive Cyclopedia, one of the forward springs in the main spring group, and one of the rearward springs in the main spring group bears upon the underside, or short side of a wedge. One of the long sides, typically an hypotenuse of a wedge, engages a notch, or seat, formed near the outboard end of the truck bolster, and the third side has the friction face that abuts, and bears against, the friction face of the side column (either front or rear, as the case may be), of the side frame. The action of this pair of wedges then provides damping of the various truck motions. In this type of truck the friction force varies directly with the compression of the springs, and increases and decreases as the truck flexes. In the vertical bounce condition, both friction surfaces work in the same direction. In the warping direction (when one wheel rises or falls relative to the other wheel on the same side, thus causing the side frame to pivot about the truck bolster) the friction wedges work in opposite directions against the restoring force of the springs.

The "hunting" phenomenon has been noted above. Hunting generally occurs on tangent (i.e., straight) track as rail car speed increases. It is desirable for the hunting threshold to occur at a speed that is above the operating speed range of the rail car. During hunting the side frames tend to want to rotate about a vertical axis to a non-perpendicular angular orientation relative to the truck bolster sometimes called "parallelogramming". This will tend to cause lateral deflection of the spring group, and will tend to generate a squeezing force on opposite diagonal sides of the wedges, causing them to tend to bear against the side frame columns. This diagonal action will tend to generate a restoring moment working against the angular deflection. The moment arm of this restoring force is proportional to half the width of the wedge, since half of the friction plate lies to either side of the centreline of the side frame. This tends to be a relatively weak moment connection, and the wedge, even if wider than normal, tends to be positioned over a single spring in the spring group.

Typically, for a truck of fixed wheelbase length, there is a trade-off between wheel load equalisation and resistance to hunting. Where a car is used for carrying high density commodities at low speeds, there may tend to be a higher emphasis on maintaining wheel load equalisation. Where a car is light, and operates at high speed there will be a greater emphasis on avoiding hunting. In general the parallelogram deformation of the truck in hunting is deterred by making the truck laterally more stiff. Another method is to use a transom, typically in the form of a channel running from between the side frames below the spring baskets.

One way to raise the hunting threshold is to employ a truck having a longer wheelbase, or one whose length is proportionately great relative to it width. For example, at present two axle truck wheelbases may range from about 5'-3" to 6' -0". However, the standard North America track gauge is 4'-8½", giving a wheelbase to track width ratio possibly as small as 1.12. At 6'-0" the ratio is roughly 1.27. It would be preferable to employ a wheelbase having a longer aspect ratio relative to the track gauge. As described herein, one aspect of the present invention employs a truck with a longer wheelbase, preferably about 86 inches, giving a ratio of 1.52. This increase in wheelbase length may tend also to be benign in terms of wheel loading equalisation.

Another way to raise the hunting threshold is to increase the parallelogram stiffness between the bolster and the side frames. It is possible, as described herein, to employ two wedges, of comparable size to those previously used, the two wedges being placed side by side and each supported by a different spring, or being the outer two wedges in a three deep spring group, to give a larger moment arm to the restoring force and to the damping associated with that force.

SUMMARY OF THE INVENTION

In an aspect of the invention there is a rail road freight car having at least one rail car unit. The rail road freight car is supported by three piece rail car trucks for rolling motion along rail road tracks. Each of the three piece trucks has a rigid truck bolster and a pair of first and second side frame assemblies. The bolster has first and second ends and the side frames are mounted at either end of the truck bolster. The three piece trucks each have a resilient suspension mounted between the truck bolster and the side frames. The rail road freight car has a sprung mass. A first portion of the sprung mass is carried by a first of the rail car trucks. The resilient suspensions of the first of the trucks has a vertical bounce spring rate. The rail car truck suspension has a natural vertical bounce frequency. The frequency is the square root of the value obtained by dividing the first spring rate by the first portion of the sprung mass. The natural vertical bounce frequency of the rail road car is less than 4.0 Hz. when the rail road car is unloaded.

In an additional feature of that aspect of the invention, each of the trucks bears a respective portion of the sprung mass of the rail road car. Each of the trucks has a vertical bounce spring rate, and each respective natural vertical bounce frequency of each of the trucks is less than 3.0 Hz. when the rail road car is empty.

In another additional feature, each of the trucks bears a respective portion of the sprung mass of the rail road car. Each of the trucks has a vertical bounce spring rate, and the rail road car has an overall natural vertical bounce frequency of less than 2.0 Hz. when the road car is empty.

In yet another additional feature, the first rail car truck has a gross rail load limit. The first rail car truck carries a first live load when the rail road car is fully loaded. The gross rail limit for the first truck is at least as great as the first portion of the rail car mass and the first live load when added together. The first rail car truck has a natural vertical bounce frequency less than 1.5 Hz. when the rail road car is fully loaded.

In still yet another additional feature, the rail road car has a fully loaded live load mass, and when fully loaded, the rail road car has a natural vertical bounce frequency of less than 1.5 hz. In a further additional feature, the rail road car has a natural vertical bounce frequency of less than 1.4 Hz. In still a further additional feature, the rail road car has at least one end-loading deck for carrying wheeled vehicles. In yet a further additional feature, the rail road car is an auto rack car. In another additional feature, the rail road car is an articulated rail road car. In still another additional feature, the rail road car is a three pack auto rack rail road car.

In yet another additional feature, the three pack autorack rail road car has a center unit and first and second end units joined at articulated connectors to the center unit. The center unit has two of the trucks mounted thereunder, and each of the end units has a single one of the trucks mounted thereunder. The articulated connectors are longitudinally offset from the trucks mounted under the center unit.

In still yet another additional feature, the rail road car includes at least one rail car unit. The rail car unit has a light car weight and a fully loaded weight, and the light car weight is at least half as great as the fully loaded weight.

In still another additional feature, the rail road car is an articulated auto rack rail road car including at least two auto rack rail car units joined at an articulated connection. At least one of the auto rack rail car units is an end unit. The end unit has a sprung weight of at least 65,000 lbs.

In a further additional feature, the rail road car is an articulated rail road car including at least two rail car units joined at an articulated connection. At least two of the rail car units are first and second end units. Each end unit has a first end having a releasable coupler mounted thereto, and a second end connected by the articulated connection to an adjacent rail car unit. The first end unit has one of the three piece trucks mounted thereunder closer to the first end having the releasable coupler than to the second end joined by the articulated connector to the adjacent car. The first end unit has a weight, and a weight distribution of the weight biased toward the coupler end thereof.

In another additional feature, the end unit has at least one ballast member mounted closer to the coupler end thereof than to the articulated connector end thereof. In still another additional feature, the ballast member is a deck plate. In yet another additional feature, as unloaded, at least 60% of the weight is carried by the truck mounted closer to the coupler end than to the articulated connector end. In still yet another additional feature, as unloaded, at least ⅔ of the weight is carried by the truck mounted closer to the coupler end than to the articulated connector end.

In a further additional feature, the rail road car has a three piece truck mounted closer to the articulation connection end of the end rail car truck than any other truck of the rail road car. When the rail road car is empty, the three piece truck mounted closer to the coupler end of the end car unit bears a dead sprung load D1. The three piece truck closest to the articulated connector bears a dead sprung load D2. D1 lies in the range of ⅔ of D2 to ⅘ of D2.

In still a further additional feature, D1 is in the range of ⅘ to ⅚ of D2. In another additional feature, D1 is in the range of 90% of D2 to 110% of D2. In still another additional feature, the first three piece truck has a wheelbase of greater than 72 inches. In yet another additional feature, the first three piece truck has a wheelbase of greater than 80 inches. In still yet another additional feature, the first three piece truck has a track width corresponding to a railroad gauge width, and a wheelbase length. The ratio of the wheelbase length to the gauge width is at least as great as 1.3:1.0. In still another additional feature, the ratio is at least as great as 1.4:1.0. In another additional feature, the first rail car truck has a set of wheels for engaging a rail road track. The rail road car has a body having a clearance above the wheels of more than 5 inches. In yet another additional feature, the clearance is at least 7 inches.

In still another additional feature, the car has a light weight corresponding to a first mass M1 when unloaded, and is rated to carry a live load of a maximum mass M2, and the ratio of M1: M2 is at least as great as 1.2:1. In still yet another additional feature, the ratio is at least as great as 1.5:1. In a further additional feature, the rail road car has a deck for carrying lading above the first rail car truck. The deck for lading lies at a height of greater than 42 inches relative to top of rail. In yet a further additional feature, the first rail car truck has a rating at least as great as "70 Ton". In still a further additional feature, the car exceeds 19'-0" in height measured from top of rail.

In still yet a further additional feature, the rail road car has a first coupler end and a second coupler end. A draft gear is mounted to the rail car at the first coupler end, and a releasable coupler is mounted to the draft gear. The draft gear has a deflection of less than 2½ inches under a buff load of 500,000 Lbs. In another additional feature, the resilient suspension includes a spring group mounted between one end of the truck bolster and one of the side frames, and a second spring group mounted between the other end of the truck bolster and the other side frame. Each of the spring groups has a spring rate constant lying in the range of 6,000 lbs/in to 10,000 lbs/in. In yet another additional feature, the spring rate constant of each of the groups has a value lying in the range of 7000 lbs/in and 9500 lbs/in.

In another aspect of the invention there is a articulated rail road freight car. At least a first rail car unit and a second rail car unit is joined at an articulated connection. The articulated rail road car is carried by rail car trucks for rolling motion along rail road tracks. At least two of the rail car units are end units. The first rail car unit is one of the end units. The first end unit has a first end and a second end. The first end of the first rail car unit has a releasable couple mounted thereto and the second end is joined by the articulated connection to the second rail car unit. A first of the trucks is mounted to the first rail car unit at a first truck center. The first truck center lies closer to the first end of the first rail car unit than to the second end. A second of the trucks is mounted closer to the articulation between the first and second rail car units than any other of the trucks. The first car unit has a weight and a dead load weight distribution. The dead load weight distribution of the first rail car unit is biased toward the first end of the first rail car unit.

In an additional feature of that aspect of the invention, as empty, at least 60% of the weight of the first rail car unit is borne by the first truck. In another additional feature, as empty, at least ⅔ of the weight of the first rail car unit is borne by the first truck. In still another additional feature, the second rail car unit has a weight distributed between the second rail car truck and a third rail car truck. When the rail road car is empty, the first rail car truck bears a first dead load, D1. The second rail car truck bears a second dead load, D2, and D1 is in the range of ⅔ to ⅘ of D2. In yet another additional feature, D1 is in the range of 90% to 110% of D2.

In another aspect of the invention there is an articulated rail road freight car comprising a number of rail car units connected at a number of articulated connectors. The rail car units are supported for rolling direction along rail road tracks by a number of rail car trucks. The number of articulated connectors is one less than the number of rail car units. Each articulated connector is located between two adjacent ones of the rail car units. The number of rail car trucks is one greater than the number of rail car units. The rail car units each have a dead sprung weight. The dead sprung weights of the rail cars is distributed among the trucks. An average dead sprung weight per truck, W0, is equal to the total dead sprung weight of all of the rail car units divided by the total number of the trucks. Each of the rail car truck bears a dead sprung weight, WDS. For each of the trucks WDS lies in the range of ⅔ to ⅘ of W0. In an additional feature of that aspect of the invention, for each of the trucks WDS lies in the range of 90% to 110% of W0. In another additional feature, each of the trucks has a resilient suspension having an overall vertical bounce spring rate in the range of 13,000 to 20,000 lbs per inch.

In still another additional feature, each of the trucks has a resilient suspension having an overall vertical bounce spring rate, k, and the value of the square root of the dividend obtained by dividing k by a mass equal to W0/g yields a natural frequency of less than 2 Hz when the articulated freight car is unloaded. In yet another additional feature, at least one of the rail car trucks has a wheelbase to track gauge width ratio greater than 1.3.

In another aspect of the invention there is a three piece freight car truck comprising a rigid truck bolster having a first end and a second end. A first side frame is mounted at the first end of the truck bolster. A second side frame is mounted at the second end of the bolster. A first spring group is mounted between the first side frame and the first end of the bolster. A second spring group is mounted between the second side frame and the second end of the truck bolster. Wheel sets each have a first and second wheel mounted on a pair of first and second axles. The first and second wheels are spaced apart from each other a distance corresponding to a track gauge width. The first and second axles are mounted between the first and second side frames. The wheel sets have a wheel base length that is (a) greater than 72 inches and (b) at least 1.3 times as great as the track gauge width.

In an additional feature of that aspect of the invention, the truck has a load carrying capacity at least as great as an AAR 70 Ton truck, and each of the spring groups has a vertical spring rate constant of less than 10,000 lbs./in.

In another aspect of the invention there is a three piece freight car truck comprising a rigid truck bolster having a first end and a second end. The truck bolster has a center plate and a truck center. The truck bolster extends in along a transverse axis defined through the truck center. A first side frame is mounted at the first end of the truck bolster. A second side frame is mounted at the second end of the bolster. The side frames extend in a longitudinal direction relative to the truck bolster. A first spring group is mounted between the first side frame and the first end of the bolster. A second spring group is mounted between the second side frame and the second end of the truck bolster. Wheel sets each having a first and second wheel is mounted on a pair of first and second axles. The first and second axles are mounted between the first and second side frames and spaced in a longitudinal direction relative to each other. Friction dampers are mounted to provide damping to the spring groups during motion of the side frames relative to the truck bolster. Each of the side frames has a first pair of friction dampers and a second pair of friction dampers. The first pair of friction dampers are mounted longitudinally to one side of a vertical transverse plane passing through the truck center of the truck bolster. The second pair of friction dampers are mounted to the other side of the vertical transverse plane. The first pair of friction dampers includes a first inboard damper and a first outboard damper. The first outboard damper is located transversely outboard of the first inboard damper. The second pair of friction dampers includes a second inboard damper and a second outboard damper. The second outboard damper is located transversely outboard of the second inboard damper. Each of the first inboard and first outboard friction dampers are independently sprung. Each of the second inboard and second outboard dampers is independently sprung.

In an additional feature of that aspect of the invention, each of the first and second side frames has a lower frame member, an upper frame member, and fore and aft vertical columns, the upper frame member. The lower frame member and the columns co-operate to define an opening in the side frame through which one end of the truck bolster is introduced. The lower frame member has a spring seat. The spring group has an inboard row of springs and an outboard row of springs seated in the spring seat of the lower frame member. Each of the columns has an inboard friction bearing surface portion and an outboard friction bearing surface portion.

DETAILED DESCRIPTION OF THE INVENTION

Figure 1A:
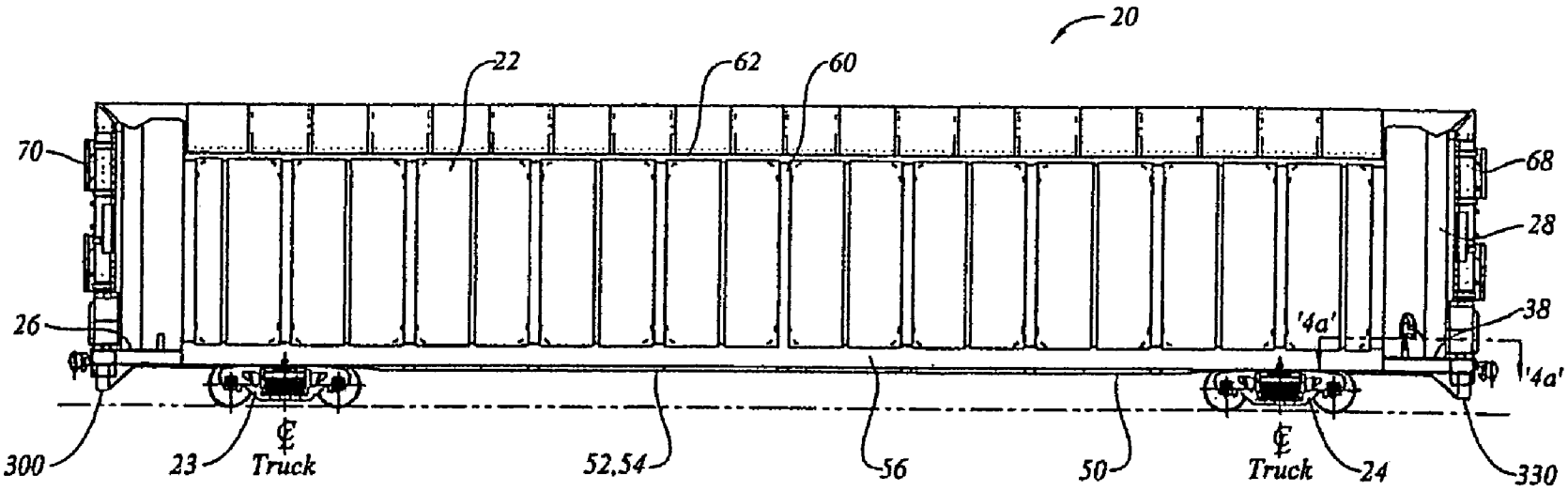
FIG. 1*a* shows a side view of a single unit auto rack rail road car.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit, indicated as CL—Rail Car. The term "longitudinally inboard", or "longitudinally outboard" is a distance taken relative to a mid-span lateral section of the car, or car unit. Pitching motion is angular motion of a rail car unit about a horizontal axis perpendicular to the longitudinal direction. Yawing is angular motion about a vertical axis. Roll is angular motion about the longitudinal axis.

Portions of this description relate to rail car trucks. Several AAR standard truck sizes are listed at page 711 in the 1997 Car & Locomotive Cyclopedia. As indicated, for a single unit rail car having two trucks, a "40 Ton" truck rating corresponds to a maximum gross car weight on rail of 142,000 lbs. Similarly, "50 Ton" corresponds to 177,000 lbs, "70 Ton" corresponds to 220,000 lbs, "100 Ton" corresponds to 263,000 lbs, and "125 Ton" corresponds to 315,000 lbs. In each case the load limit per truck is then half the maximum gross car weight on rail.

Figure 1B:
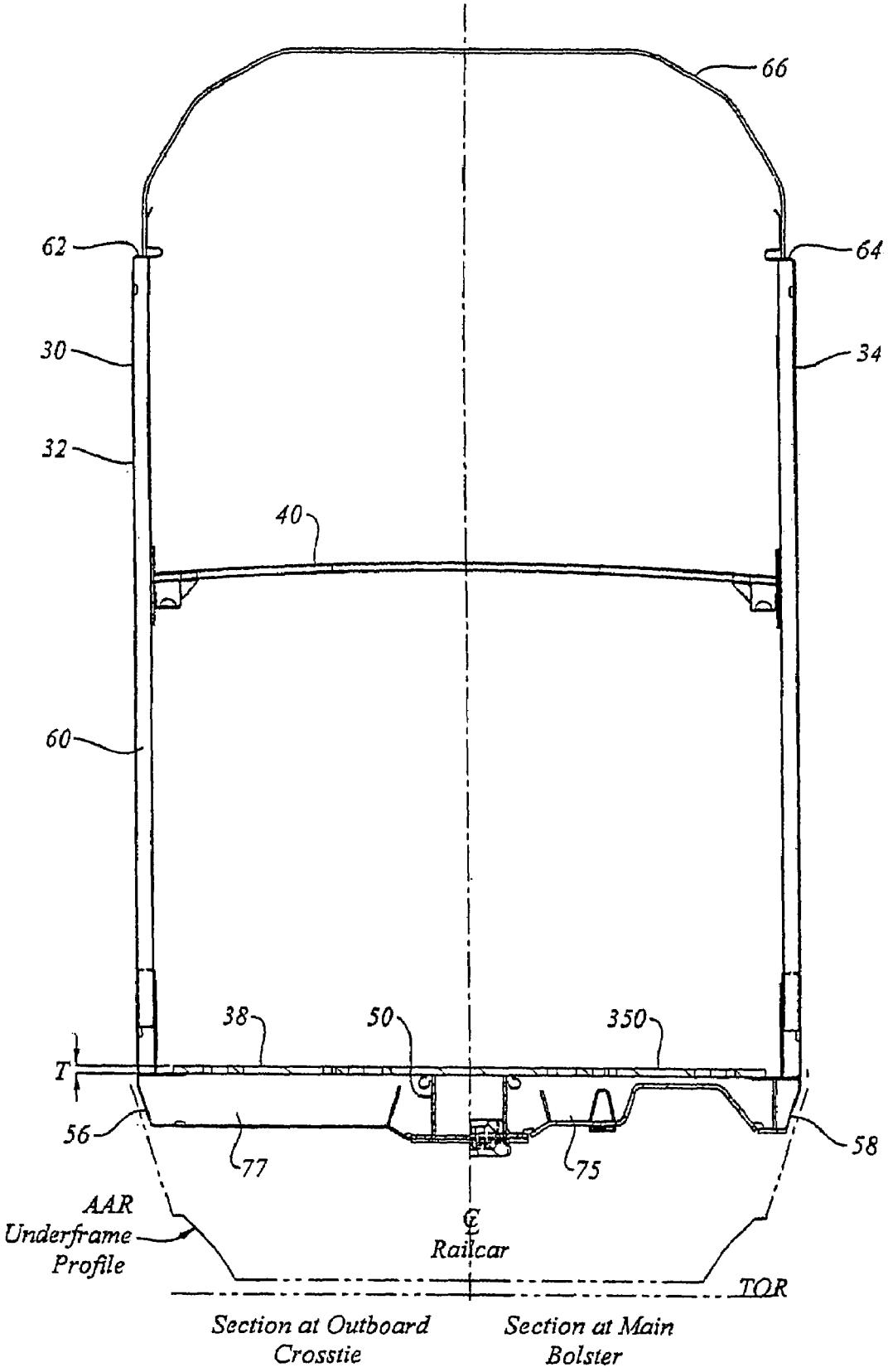
FIG. 1*b* shows a cross-sectional view of the auto-rack rail road car of FIG. 1*a* in a bi-level configuration, one half section of FIG. 1*b* being taken through the main bolster and the other half taken looking at the cross-tie outboard of the main bolster.

FIGS. 1*a*, 2*a*, 2*b*, 3*a*, and 3*b*, show different types of auto rack rail road car, all sharing a number of similar features. FIG. 1*a* (side view) shows a single unit autorack rail road car, indicated generally as 20. It has a rail car body 22 supported for rolling motion in the longitudinal direction (i.e., along the rails) upon a pair of rail car trucks 23 and 24 mounted at main bolsters at either of the first and second ends 26, 28 of rail car body 22. Body 22 has a housing structure 30, including a pair of left and right hand sidewall structures 32, 34 and a canopy, or roof 36 that co-operate to define an enclosed lading space. Body 22 has staging in the nature of a main deck 38 running the length of the car between first and second ends 26, 28 upon which wheeled vehicles, such as automobiles can be conducted. Body 22 can have staging in either a bi-level configuration, as shown in FIG. 1*b*, in which a second, or upper deck 40 is mounted above main deck 38 to permit two layers of vehicles to be carried; or a tri-level configuration a mid-level deck, similar to deck 40, and a top deck, also similar to deck 40, are mounted above each other, and above main deck 38 to permit three layers of vehicles to be carried. The staging, whether bi-level or tri-level, is mounted to the sidewall structures 32, 34. Each of the decks defines a roadway, trackway, or pathway, by which wheeled vehicles such as automobiles can be conducted between the ends of rail road car 20.

A through center sill 50 extends between ends 26, 28. A set of cross-bearers 52, 54 extend to either side of center sill 50, terminating at side sills 56, 58. Main deck 38 is supported above cross-bearers 52, 54 and between side sills 56, 58. Sidewall structures 32, 34 each include an array of vertical support members, in the nature of posts 60, that extend between side sills 56, 58, and top chords 62, 64. A corrugated sheet roof 66 extends between top chords 62 and 64 above deck 38 and such other decks as employed. Radial arm doors 68, 70 enclose the end openings of the car, and are movable to a closed position to inhibit access to the interior of car 20, and to an open position to give access to the interior. Each of the decks has bridge plate fittings (not shown) to permit bridge plates to be positioned between car 20 and an adjacent car when doors 68 or 70 are opened to permit circus loading of the decks.

Two-Unit Articulated Auto Rack Car

Figure 2B:
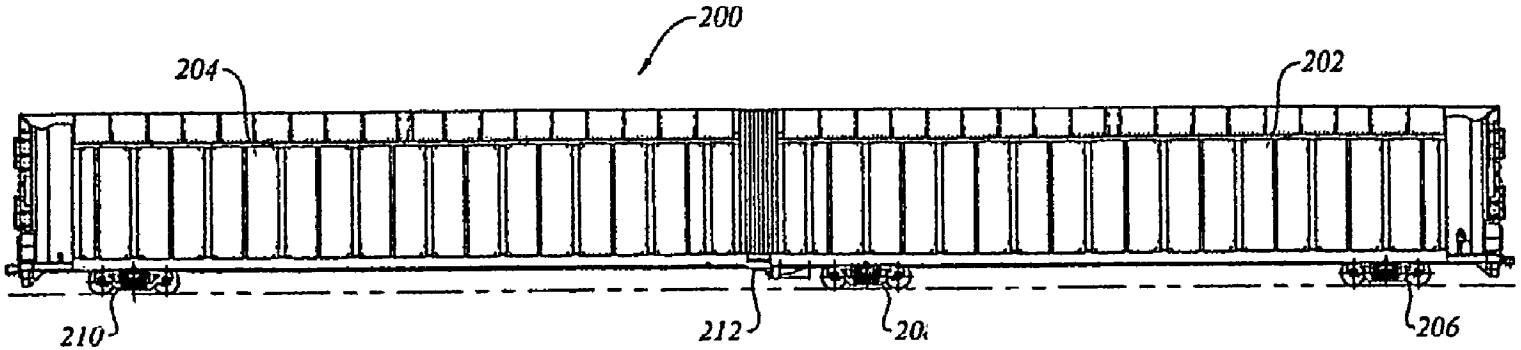
FIG. 2*b* shows a side view of an alternate auto rack rail road car to that of FIG. 2*a*, having a cantilevered articulation.
Figure 2A:
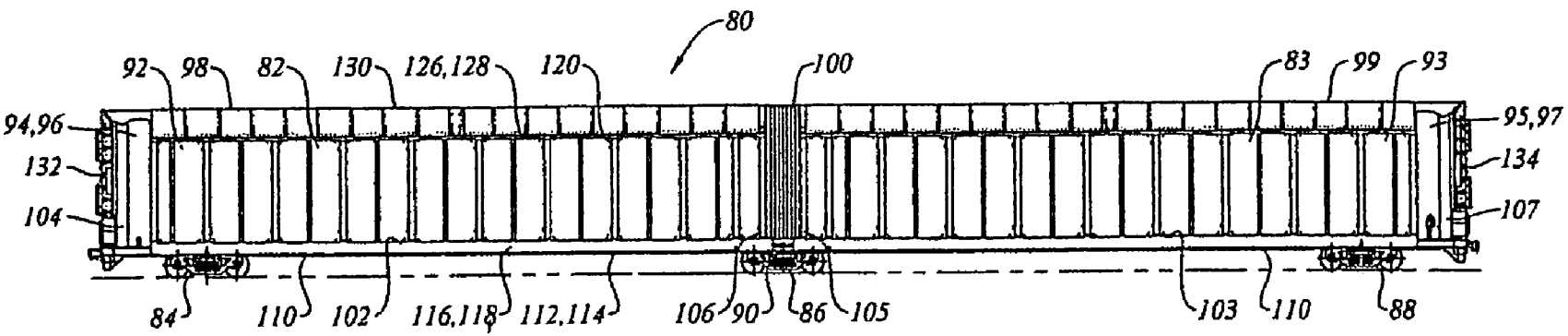
FIG. 2*a* shows a side view of a two unit articulated auto rack rail road car.

Similarly, FIG. 2*a* shows an articulated two unit auto rack rail road car, indicated generally as 80. It has a first rail car unit body 82, and a second rail car unit body 85, both supported for rolling motion in the longitudinal direction (i.e., along the rails) upon rail car trucks 84, 86 and 88. Rail car trucks 84 and 88 are mounted at main bolsters at respective coupler ends of the first and second rail car unit bodies 83 and 84. Truck 86 is mounted beneath articulated connector 90 by which bodies 83 and 84 are joined together. Each of bodies 83 and 84 has a housing structure 92, 93, including a pair of left and right hand sidewall structures 94, 96 (or 95, 97) and a canopy, or roof 98 (or 99) that define an enclosed lading space. A bellows structure 100 links bodies 82 and 83 to discourage entry by vandals or thieves.

Each of bodies 82, 83 has staging in the nature of a main deck 102 (or 103) running the length of the car unit between first and second ends 104, 106 (105, 107) upon which wheeled vehicles, such as automobiles can be conducted. Each of bodies 82, 83 can have staging in either a bi-level configuration, as shown in FIG. 1*b*, or a tri-level configuration. Other than brake fittings, and other minor fittings, car unit bodies 82 and 83 are substantially the same, differing only in that car body 82 has a pair of female side-bearing arms adjacent to articulated connector 90, and car body 83 has a co-operating pair of male side bearing arms adjacent to articulated connector 90.

Each of car unit bodies 82 and 83 has a through center sill 110 that extends between the first and second ends 104, 106 (105, 107). A set of cross-bearers 112, 114 extend to either side of center sill 110, terminating at side sills 116, 118. Main deck 102 (or 103) is supported above cross-bearers 112, 114 and between side sills 116, 118. Sidewall structures 94, 96 and 95, 97 each include an array of vertical support members, in the nature of posts 120, that extend between side sills 116, 118, and top chords 126, 128. A corrugated sheet roof 130 extends between top chords 126 and 128 above deck 102 and such other decks as employed.

Radial arm doors 132, 134 enclose the coupler end openings of car bodies 82 and 83 of rail road car 80, and are movable to respective closed positions to inhibit access to the interior of rail road car 80, and to respective open positions to give access to the interior thereof. Each of the decks has bridge plate fittings (upper deck fittings not shown) to permit bridge plates to be positioned between car 80 and an adjacent auto rack rail road car when doors 132 or 134 are opened to permit circus loading of the decks.

Figures 1C, 1D:
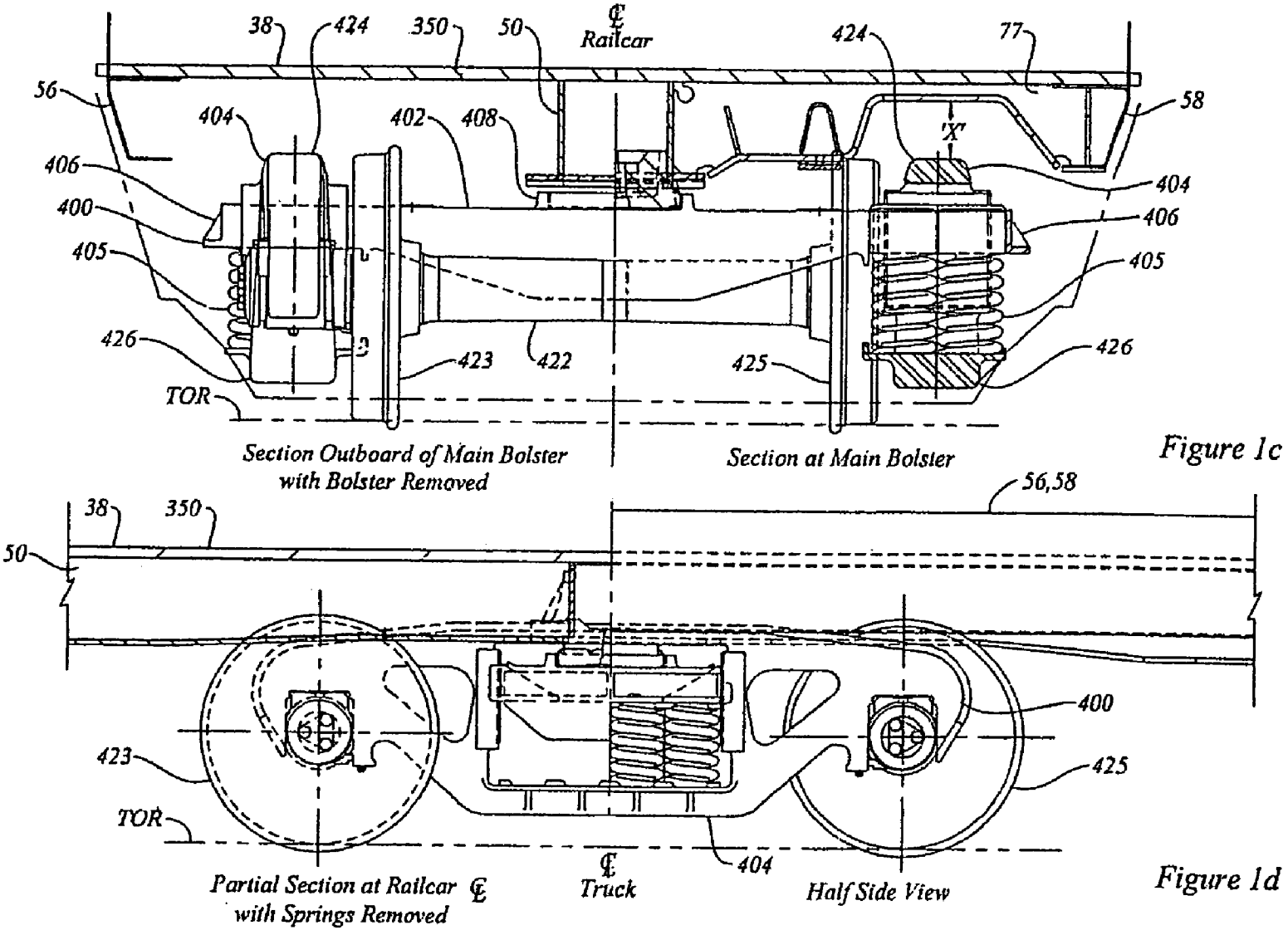
FIG. 1*c* shows a half sectioned partial end view of the rail road car of FIG. 1*a* illustrating the wheel clearance below the main deck, half of the section being taken through the main bolster, the other half section being taken outboard of the truck with the main bolster removed for clarity.
FIG. 1*d* shows a partially sectioned side view of the rail road car of FIG. 1*c* illustrating the relationship of the truck, the bolster and the wheel clearance, below the main deck.

For the purposes of this description, the cross-section of FIG. 1*b* can be considered typical also of the general structure of the other rail car unit bodies described below, whether 82, 85, 202, 204, 142, 144, 146, 222, 224 or 226. It should be noted that FIG. 1*b* shows a stepped section in which the right hand portion shows the main bolster 75 and the left hand section shows a section looking at the cross-tie 77 outboard of the main bolster. The sections of FIGS. 1*b* and 1*c* are typical of the sections of the end units described herein at their coupler end trucks, such as trucks 232, 148, 84, 88, 210, 206. The upward recess in the bolster provides vertical clearance for the side frames (typically 7" or more).

Three or More Unit Articulated Auto Rack Car

Figure 3B:
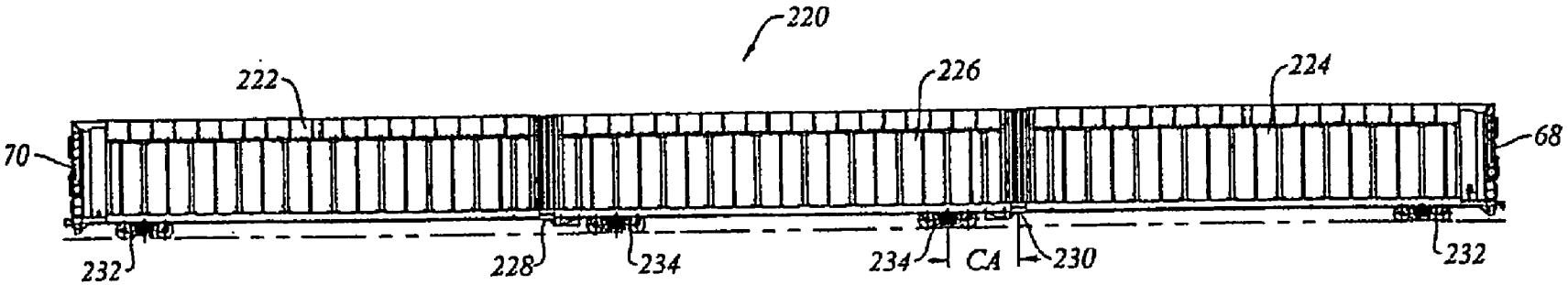
FIG. 3*b* shows a side view of an alternate three unit auto rack rail road car to the articulated rail road unit car of FIG. 3*a*, having cantilevered articulations.
Figure 3A:
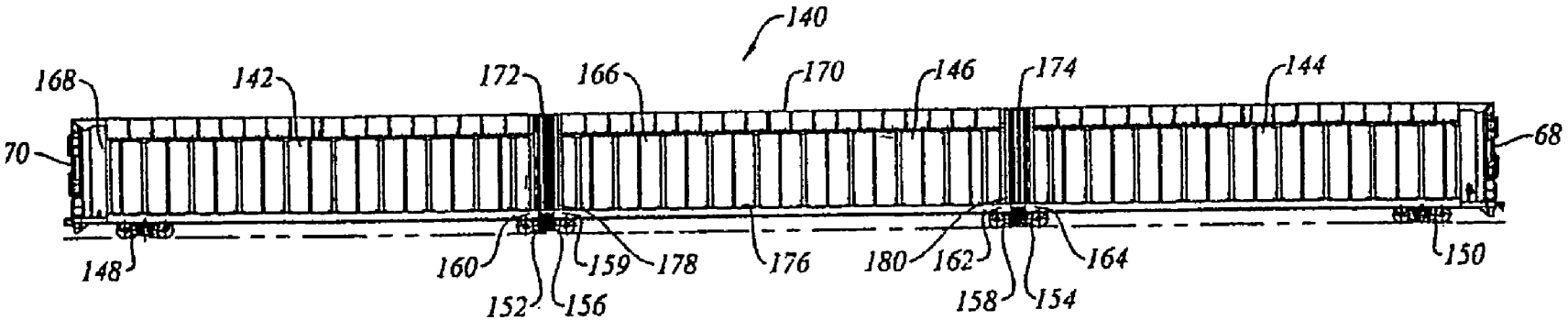
FIG. 3*a* shows a side view of a three unit auto rack rail road car.

FIG. 3*a* shows a three unit articulated autorack rail road car, generally as 140. It has a first end rail car unit body 142, a second end rail car unit body 144, and an intermediate rail car unit body 146 between rail car unit bodies 142 and 144. Rail car unit bodies 142, 144 and 146 are supported for rolling motion in the longitudinal direction (i.e., along the rails) upon rail car trucks 148, 150, 152, and 154. Rail car trucks 148 and 150 are "coupler end" trucks mounted at main bolsters at respective coupler ends of the first and second rail car bodies 142 and 144. Trucks 152 and 154 are "interior" or "intermediate" trucks mounted beneath respective articulated connectors 156 and 158 by which bodies 142 and 144 are joined to body 146. For the purposes of this description, body 142 is the same as body 82, and body 144 is the same as body 83. Rail car body 146 has a male end 159 for mating with the female end 160 of body 142, and a female end 162 for mating with the male end 164 of rail car body 144.

Body 146 has a housing structure 166 like that of FIG. 1*b*, that includes a pair of left and right hand sidewall structures 168 and a canopy, or roof 170 that co-operate to define an enclosed lading space. Bellows structures 172 and 174 link bodies 142, 146 and 144, 146 respectively to discourage entry by vandals or thieves.

Body 146 has staging in the nature of a main deck 176 running the length of the car unit between first and second ends 178, 180 defining a roadway upon which wheeled vehicles, such as automobiles can be conducted. Body 146 can have staging in either a bi-level configuration or a tri-level configuration, to co-operate with the staging of bodies 142 and 144.

Other than brake fittings, and other minor fittings, car bodies 142 and 144 are substantially the same, differing only in that car body 142 has a pair of female side-bearing arms adjacent to articulated connector 156, and car body 144 has a co-operating pair of male side bearing arms adjacent to articulated connector 158.

Other articulated auto-rack cars of greater length can be assembled by using a pair of end units, such as male and female end units 82 and 83, and any number of intermediate units, such as intermediate unit 146, as may be suitable. In that sense, rail road car 140 is representative of multi-unit articulated rail road cars generally.

Alternate Configurations

Alternate configurations of multi-unit rail road cars are shown in FIGS. 2*b* and 3*b*. In FIG. 2*b*, a two unit articulated auto-rack rail road car is indicated generally as 200. It has first and second rail car unit bodies 202, 204 supported for rolling motion in the longitudinal direction by three rail road car trucks, 206, 208 and 210 respectively. Rail car unit bodies 202 and 204 are joined together at an articulated connector 212. In this instance, while rail car bodies 202 and 204 share the same basic structural features of rail car body 22, in terms of a through center sill, cross-bearers, side sills, walls and canopy, and vehicles decks, rail car body 202 is a "two-truck" body, and rail car body 204 is a single truck body. That is, rail car body 202 has main bolsters at both its first, coupler end, and at its second, articulated connector end, the main bolsters being mounted over trucks 206 and 208 respectively. By contrast, rail car body 204 has only a single main bolster, at its coupler end, mounted over truck 210. Articulated connector 212 is mounted to the end of the respective center sills of rail car bodies 202 and 204, longitudinally outboard of rail car truck 208. The use of a cantilevered articulation in this manner, in which the pivot center of the articulated connector is offset from the nearest truck center, is described more fully in my co-pending U.S. patent application Ser. No. 09/614,815 for a Rail Road Car with Cantilevered Articulation filed Jul. 12, 2000, incorporated herein by reference, and may tend to permit a longer car body for a given articulated rail road car truck center distance as therein described.

Figure 3C:
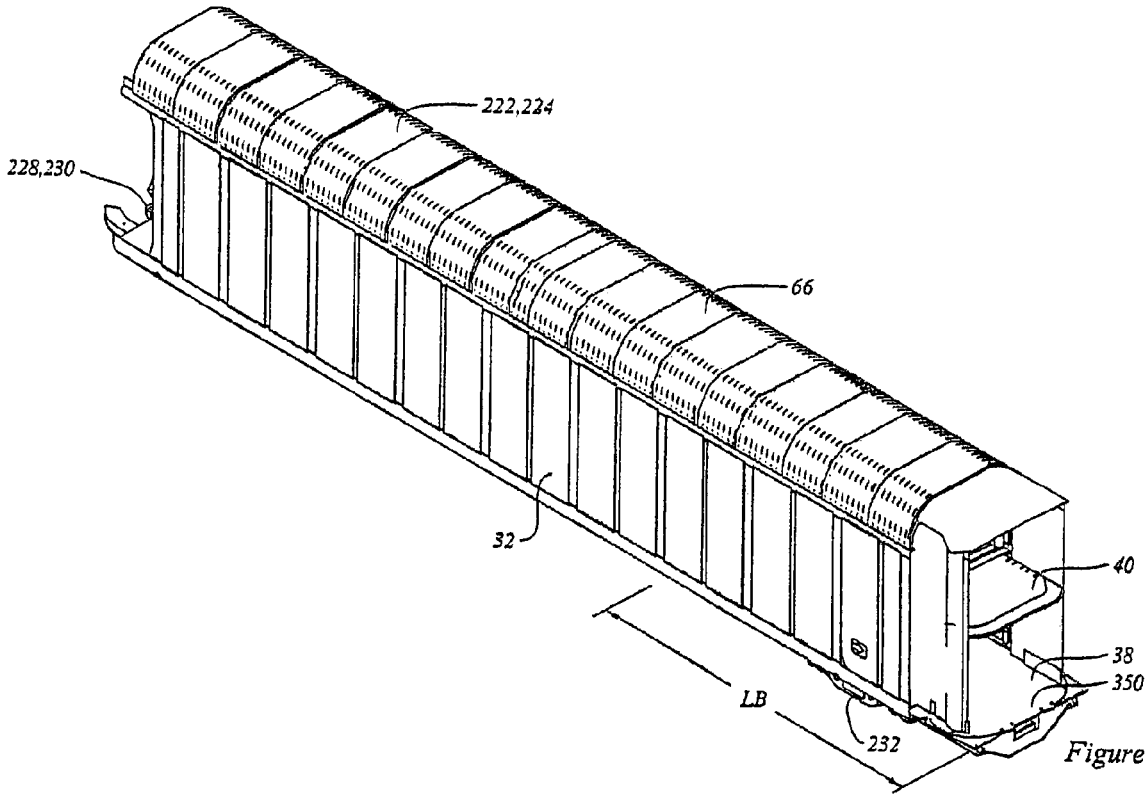
FIG. 3*c* shows an isometric view of an end unit of the three unit auto rack rail road car of FIG. 3*b;*

FIG. 3*b* shows a three-unit articulated rail road car 220 having first end unit 222, second end unit 224, and intermediate unit 226, with cantilevered articulated connectors 228 and 230. End units 222 and 224 are single truck units of the same construction as car body 204. Intermediate unit 226 is a two truck unit having similar construction to car body 202, but having articulated connectors at both ends, rather than having a coupler end. FIG. 3*c* shows an isometric view of end unit 224 (or 222). Analogous five pack articulated rail road cars having cantilevered articulations can also be produced. Many alternate configurations of multi-unit articulated rail road cars employing cantilevered articulations can be assembled by re-arranging, or adding to, the units illustrated.

In each of the foregoing descriptions, each of rail road cars 20, 80, 140, 200 and 220 has a pair of first and second coupler ends by which the rail road car can be releasably coupled to other rail road cars, whether those coupler ends are part of the same rail car body, or parts of different rail car bodies of a multi-unit rail road car joined by articulated connections, draw-bars, or a combination of articulated connections and draw-bars.

Figure 4A:
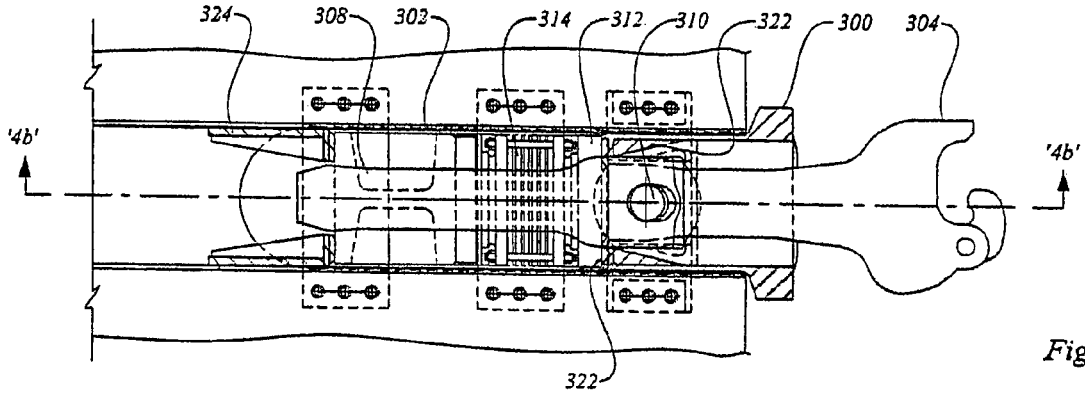
FIG. 4*a* is a partial side sectional view of the draft pocket of the coupler end of any of the rail road cars of FIGS. 1*a*, 2*a*, 2*b*, 3*a*, or 3*b* taken on '4*a*-4*a*' as indicated in FIG. 1*a;*
Figure 4B:
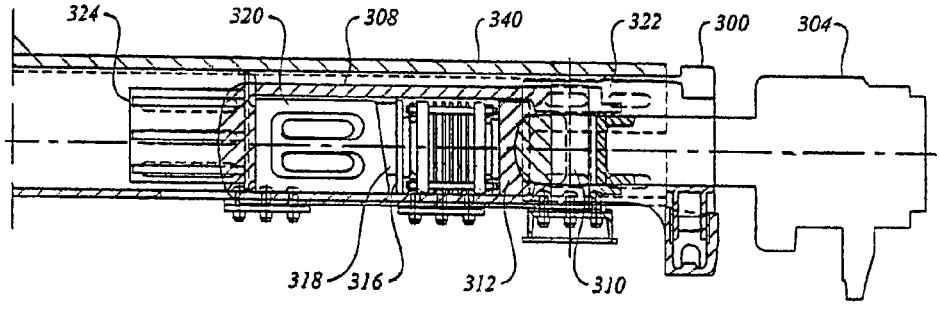
FIG. 4*b* shows a top view of the draft gear at the coupler end of FIG. 4*a* taken on '4*b*-4*b*' of FIG. 4*a;*

FIGS. 4*a* and 4*b* show the draft gear at a first coupler end 300 of rail road car 20, coupler end 300 being representative of either of the coupler ends and draft gear arrangement of rail road car 20, and of rail road cars 80, 140, 200 and 220 more generally. Coupler pocket 302 houses a coupler indicated as 304. It is mounted to a coupler yoke 308, joined together by a pin 310. Yoke 308 houses a coupler follower 312, a draft gear 314 held in place by a shim (or shims, as required) 316, a wedge 318 and a filler block 320. Fore and aft draft gear stops 322, 324 are welded inside coupler pocket 302 to retain draft gear 314, and to transfer the longitudinal buff and draft loads through draft gear 314 and on to coupler 304. In the preferred embodiment, coupler 304 is an AAR Type F70DE coupler, used in conjunction with an AAR Y45AE coupler yoke and an AAR Y47 pin. In the preferred embodiment, draft gear 314 is a Mini-BuffGear such as manufactured Miner Enterprises Inc, supra., or by the Keystone Railway Equipment Company, of 3420 Simpson Ferry Road, Camp Hill, Pa. As taken together, this draft gear and coupler assembly yields a reduced slack, or low slack, short travel, coupling as compared to an AAR Type E coupler with standard draft gear or hydraulic EOCC device. As such it may tend to reduce overall train slack. In addition to mounting the Mini-BuffGear directly to the draft pocket, that is, coupler pocket 302, and hence to the structure of the rail car body of rail road car 20, (or of the other rail road cars noted above) the construction described and illustrated is free of other long travel draft gear, sliding sills and EOCC devices, and the fittings associated with them.

Mini-BuffGear has between ⅝ and ¾ of an inch in buff at a compressive force greater than 700,000 Lbs. Other types of draft gear can be used that will give an official rating travel of less than 2½ inches under M-901-G, or if not rated, then a travel of less than 2.5 inches under 500,000 Lbs. buff load. For example, while Mini-BuffGear is preferred, other draft gear is available having a travel of less than 1¾ inches at 400,000 Lbs., buff load, one known type has about 1.6 inches of travel at 400,000 Lbs., buff load. It is even more advantageous for the travel to be less than 1.5 inches at 700,000 Lbs. buff load and, as in the embodiment of FIGS. 6*a* and 6*b*, preferred that the travel be at least as small as 1" inches or less at 700,000 Lbs. buff load.

Similarly, while the AAR Type F70DE coupler is preferred, other types of coupler having less than the 25/32" (that is, less than about ¾") nominal slack of an AAR Type E coupler generally or the 20/32" slack of an AAR E50ARE coupler can be used. In particular, in alternative embodiments with appropriate housing changes where required, AAR Type F79DE and Type F73BE, with or without top or bottom shelves; AAR Type CS; or AAR Type H couplers can be used to obtain reduced slack relative to AAR Type E couplers.

In each of the autorack rail car embodiments described above, each of the car units has a weight, that weight being carried by the rail car trucks with which the car is equipped. In each of the embodiments of articulated rail cars described above there is a number of rail car units joined at a number of articulated connectors, and carried for rolling motion along rail car tracks by a number of rail car trucks. In each case the number of articulated car units is one more than the number of articulations, and one less than the number of trucks. In the event that some of the cars units are joined by draw bars the number of articulated connections will be reduced by one for each draw bar added, and the number of trucks will increase by one for each draw bar added. Typically articulated rail road cars have only articulated connections between the car units. All cars described have releasable couplers mounted at their opposite ends.

In each case described above, where at least two car units are joined by an articulated connector, there are end trucks (e.g. 150, 232) inset from the coupler ends of the end car units, and intermediate trucks (e.g. 154, 234) that are mounted closer to, or directly under, one or other of the articulated connectors (e.g. 156, 230). In a car having cantilevered articulations, such as shown in FIG. 36, the articulated connector is mounted at a longitudinal offset distance (the cantilever arm CA) from the truck center. In each case, each of the car units has an empty weight, and also a design full weight. The full weight is usually limited by the truck capacity, whether 70 ton, 100 ton, 110 ton (286,000 lbs.) or 125 ton. In some instances, with low density lading, the volume of the lading is such that the truck loading capacity cannot be reached without exceeding the volumetric capacity of the car body.

The dead sprung weight of a rail car unit is generally taken as the body weight of the car, including any ballast, as described below, plus that portion of the weight of the truck bearing on the springs, that portion most typically taken as being the weight of the truck bolsters. The unsprung weight of the trucks is, primarily, the weight of the side frames, the axles and the wheels, plus ancillary items such as the brakes, springs, and axle bearings. The unsprung weight of a three piece truck may generally be about 8800 lbs. The live load is the weight of the lading. The sum of the live load and the dead sprung load and the unsprung weight of the trucks is the gross rail car weight on rail, and must not exceed the rated value for the trucks.

In each of the embodiments described above, each of the rail car units has a weight and a weight distribution of the dead sprung weight of the carbody which determines the dead sprung load carried by each truck. In each of the embodiments described above, the sum of the sprung weights of all of the car bodies of an articulated car is designated as W0. (The sprung mass, M0, is the sprung weight W0 divided by the gravitational constant, g. In each case where a weight is given herein, it is understood that conversion to mass can be readily made in this way, particularly as when calculating natural frequencies). For a single unit symmetrical rail road car, such as car 20, the weight on both trucks is equal. In all of the articulated auto rack rail road car embodiments described above, the distributed sprung weight on any end truck, is at least ⅔, and no more than ⅘ of the nearest adjacent truck, such as an interior truck next closest to the nearest articulated connector. It is advantageous that the dead sprung weight be in the range of ⅘ to ⅚ of the interior truck, and it is preferred that the dead sprung weight be in the range of 90% to 110% of the interior truck. It is also desirable that the dead sprung weight on any truck, WDS, fall in the range of 90% to 110% of the value obtained by dividing W0 by the total number of trucks of the rail road car. Similarly, it is desirable that the maximum live load carried by each of the trucks be roughly similar such that the overall truck loading is about the same, and ideally equal. In any case, for the embodiments described above, the design live load for and one truck can be taken as being at least 60% of the load of the next adjacent truck, and advantageously 75% of the load. In terms of overall dead and live loads, in each of the embodiments described the overall sprung load is at least 70% of the nearest adjacent truck, advantageously 80% or more, and preferably 90% of the nearest adjacent truck.

Inasmuch as the car weight would generally be more or less evenly distributed on a lineal foot basis, and as such the interior trucks would otherwise reach their load capacities before the coupler end trucks, weight equalisation is achieved in the embodiments described above by adding ballast to the end car units. That is, the dead sprung weight distribution of the end car units is biased toward the coupler end, and hence toward the coupler end truck (e.g. 84, 88, 206, 210, 150, 232). For example, in the embodiments described above, a first ballast member is provided in the nature of a main deck plate 350 of unusual thickness T that forms part of main deck 38 of the rail car unit. Plate 350 extends across the width of the end car unit, and from the longitudinally outboard end of the deck a distance LB. In the embodiment of FIGS. 3*b* and 3*c* for example, the intermediate of interior truck 234 may be a 70 ton truck near its sprung load limit of about 101,200 lbs., on the basis of its share of loads from rail car units 222 and 226 (or, symmetrically 224 and 226 as the case may be), while, without ballast, end trucks 232 would be at a significantly smaller sprung load, even when rail car 220 is fully loaded. In this case, thickness T can be 1½ inches, the width can be 112 inches, and the length LB can be 312 inches, giving a weight of roughly 15,220 lbs., centered on the truck center of the end truck 232. This gives a dead load of end car unit 222 of roughly 77,000 lbs., a dead sprung load on end truck 232 of about 54,000 lbs., and a total sprung load on truck 232 can be about 84,000 lbs. By comparison, center car unit 226 has a dead load of about 60,000 lbs., with a dead sprung load on interior truck 234 of about 55,000 lbs., and the total sprung load on interior truck 234 of 101,000 lbs when car 220 is fully loaded. In this instance as much as a further 17,000 lbs. (+/−) of additional ballast can be added before exceeding the "70 Ton" gross weight on rail limit for the coupler end truck, 232. Ballast can also be added by increasing the weight of the lower flange or webs of the center sill, also advantageously reducing the center of gravity of the car.

Figure 5A:
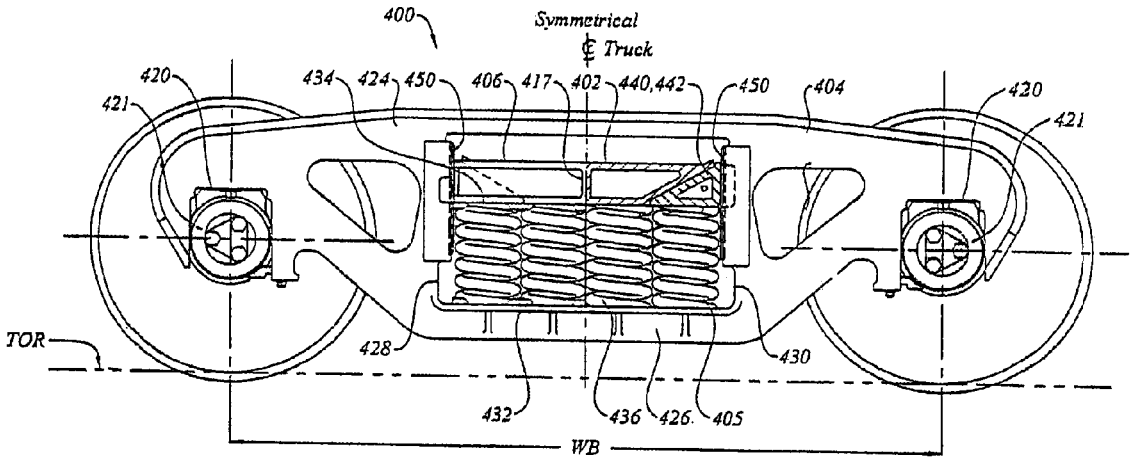
FIG. 5*a* shows a side view of a three piece truck for the auto rack rail road cars of FIGS. 1*a*, 2*a*, 2*b*, 3*a* or 3*b;*
Figure 5B:
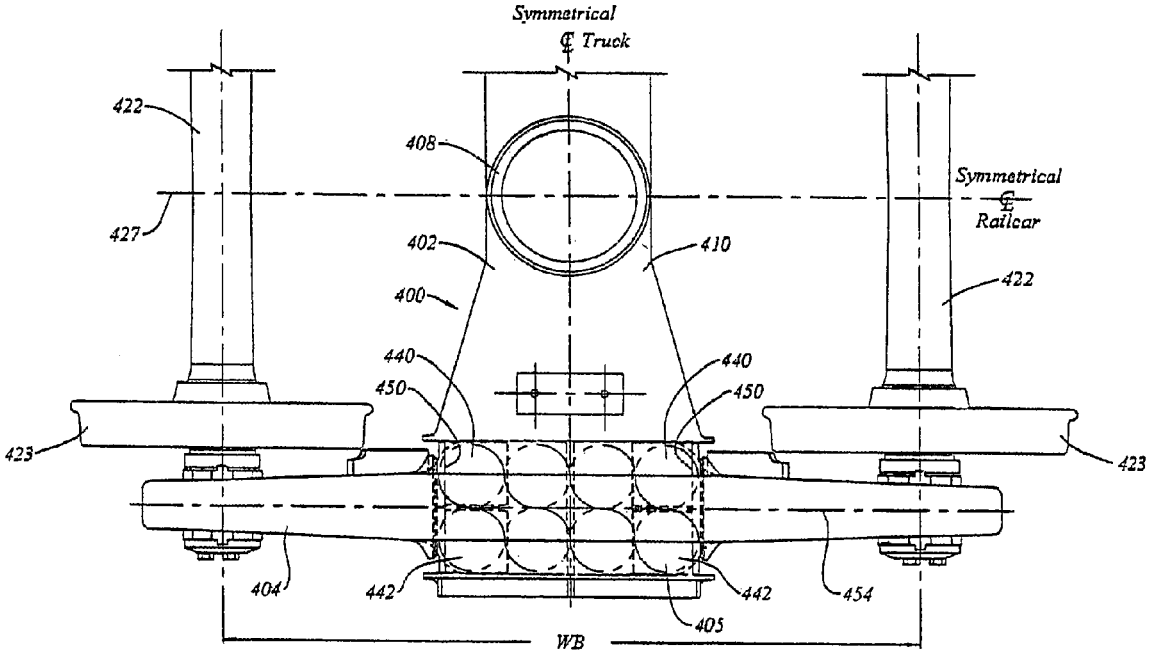
FIG. 5*b* shows a top view of half of the three piece truck of FIG. 5*a;*
Figure 5C:
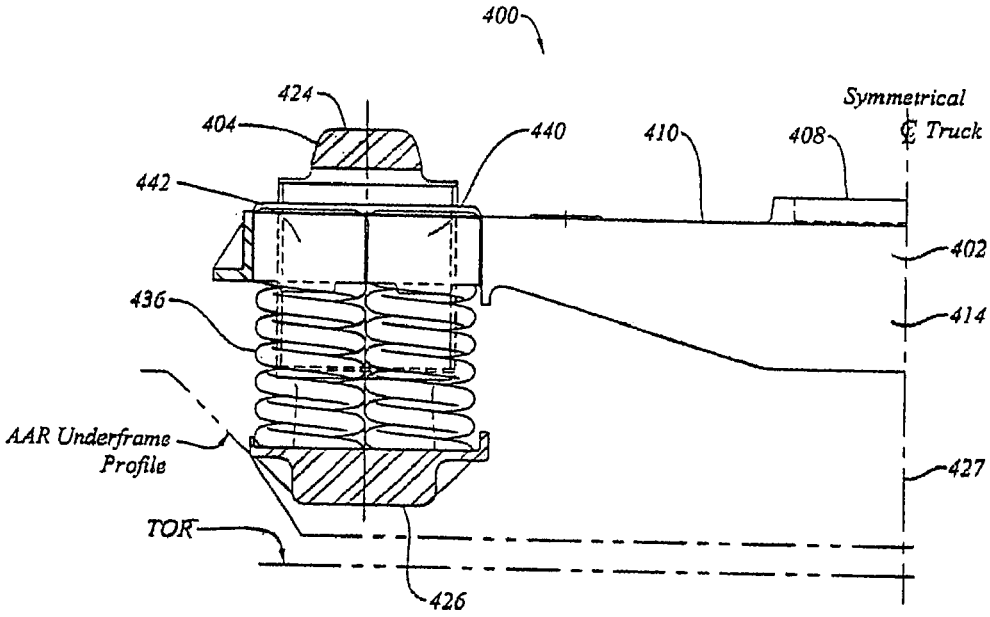
FIG. 5*c* shows a partial section of the three piece truck of FIG. 5*a* taken on '5*c*-5*c'*.

FIGS. 5*a*, 5*b*, 5*c* and 5*d* all relate to a three piece truck 400 for use with the rail road cars of FIG. 1*a*, 2*a*, 2*b*, 3*a* or 3*b*. FIGS. 1*c* and 1*d* show the relationship of this truck to the deck level of these rail road cars. Truck 400 has three major elements, those elements being a truck bolster 402, symmetrical about the truck longitudinal centreline, and a pair of first and second side frames, indicated as 404. Only one side frame is shown in FIG. 5*b* given the symmetry of truck 400. Three piece truck 400 has a resilient suspension (a primary suspension) provided by a spring groups 405 trapped between each of the distal (i.e., transversely outboard) ends of truck bolster 402 and side frames 404. The clearance 'x' in FIG. 1*c* being 7 inches in one embodiment between the side frames and the bolster.

Truck bolster 402 is a rigid, fabricated beam having a first end for engaging one side frame assembly, a second end for engaging the other side frame assembly (both ends being indicated as 406) a center plate, or center bowl 408 located at the truck center, an upper flange 410 extending between the two ends 406, being narrow at a central waist and flaring to a wider transversely outboard termination at ends 406. Truck bolster 402 also has a lower flange 412 of similar profile to upper flange 410, and two fabricated webs 414 extending between upper flange 410 and lower flange 412 to form an irregular closed section box beam. Additional webs 416 are mounted between the distal portions of upper flange 410 and 414 where bolster 402 engages the one of the spring groups 405. The transversely distal region of truck bolster 402 also has friction damper seats 416, 418 for accommodating friction damper wedges as described further below.

Side frame 404 is a casting having bearing seats 420 into which bearings 421, and a pair of axles 422 mount. Each of axles 424 has a pair of first and second wheels 423, 425 mounted to it in a spaced apart position corresponding to the width of the track gauge of the track upon which the rail car is to operate. Side frame 404 also has an upper beam member 424, a lower beam member 426, and vertical side columns 428 and 430, each lying to one side of a vertical transverse plane 425 bisecting truck 400 at the longitudinal station of the truck center. A generally rectangular opening is defined by the co-operation of the upper and lower beams members 424, 426 and vertical columns 428, 430, into which the distal end of truck bolster 402 can be introduced. The distal end of truck bolster 402 can then move up an down relative to the side frame within this opening. Lower beam member 426 has a spring seat 432 upon which spring group 405 can seat. Similarly, an upper spring seat 434 is provided by the underside of the distal portion of bolster 402 to engages the upper end of spring group 405. As such, vertical movement of truck bolster 402 will tend to compress or release the springs in spring group 405.

Spring group 405 has two rows of springs 436, a transversely inboard row and a transversely outboard row, each row having four large (8 inch +/−) diameter coil springs nested with four small diameter coil springs, giving vertical bounce spring rate constant, k, for the group of less than 10,000 lbs/inch. This spring rate constant can be in the range of 6000 to 10,000 lbs/in., and is advantageously in the range of 7000 to 9500 lbs/in, giving an overall vertical bounce spring rate for the truck of double these values, preferably in the range of 14000 to 18,500 lbs/in for the truck. The number of springs, the number of inner and outer coils, and the spring rate of the various springs can be varied to obtain the desired spring rate constant for the loading for which the truck is designed.

Each side frame assembly also has four friction damper wedges arranged in first and second pairs of transversely inboard and transversely outboard wedges 440, 442 that engage the sockets, or seats 416, 418. The corner springs in spring group 405 bear upon a friction damper wedge 440 or 442. Each of vertical columns 428, 430 has a friction wear plate 450 having transversely inboard and transversely outboard regions against which the friction faces of wedges 440, 442 can bear, respectively. The deadweight compression of the springs will tend to work on the bottom face of the wedge, trying to drive the wedge upward along the inclined face of the seat in the bolster, thus urging or biasing the friction face against the opposing portion of the friction face of the side frame column. The springs chosen can have an undeflected length of 15 inches, and a dead weight deflection of about 3 inches.

Figure 5D:
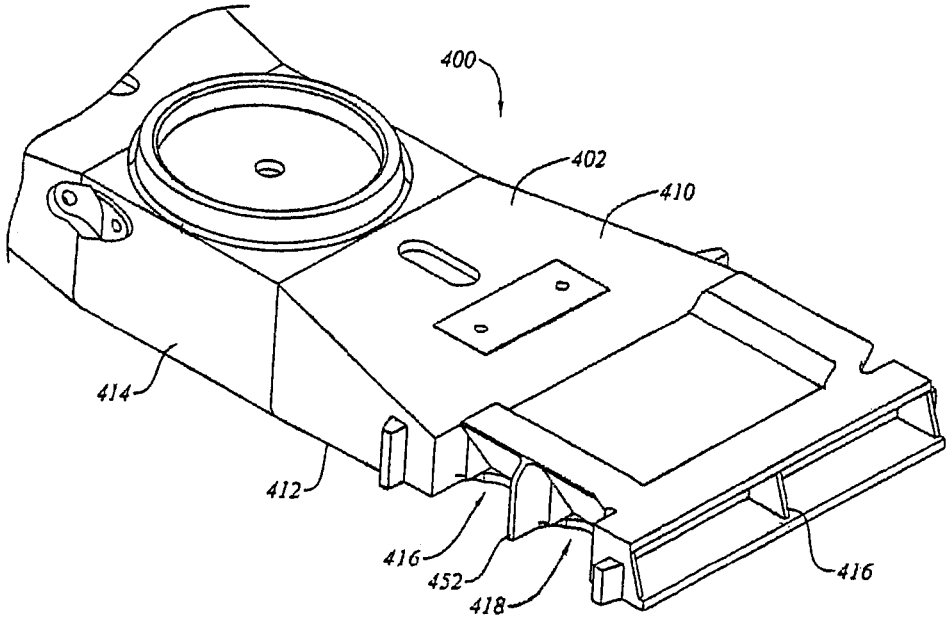
FIG. 5*d* shows a partial isometric view of the truck bolster of the three piece truck of FIG. 5*a* showing friction damper seats.

As seen in the top view of FIG. 5*b*, the side by side friction dampers have a much wider moment arm to resist angular deflection of the side frame relative to the truck bolster in the parallelogram mode than would a single such wedge located on the spring group centreline. Further, the use of independent springs under each of the wedges means that whichever wedge is jammed in tightly, there is always a dedicated spring under that specific wedge to resist the deflection. In contrast to older designs, the overall damping face width is greater because it is sized to be driven by larger diameter (e.g., 8 in +/−) springs, as compared to the smaller diameter of, for example, AAR D5 springs, or smaller. Further, in having two elements side-by-side the effective width of the damper is doubled, and the effective moment arm over which the diagonally opposite dampers work to resist parallelogram deformation of the truck in hunting and curving is double, or more, than it would have been for a single damper. In the illustration of FIG. 5*d*, the damper seats are shown as being segregated by a partition 452. If a longitudinal vertical plane 454 is drawn through truck 400 through the center of partition 452, it can be seen that the inboard dampers lie to one side of plane 454, and the outboard dampers lie to the outboard side of plane 454. In hunting then, the normal force from the damper working against the hunting will tend to act in a couple in which the force on the friction bearing surface of the inboard pad will always be fully inboard of plane 454 on one end, and fully outboard on the other diagonal friction face. Put differently, the center of force acting on the inboard friction face of wedge 440 against column 428 is offset transversely relative to the diagonally outboard friction face of wedge 442 against column 430 by a distance that is at least as great as one full diameter of the large spring coils in the spring set. This is significantly greater than found in conventional friction dampers. Further, in conventional friction damper wedges, the enclosed angle of the wedge tends to be somewhat less than 35 degrees measured from the vertical face to the sloped face against the bolster. As the wedge angle decreases toward 30 degrees, the tendency of the wedge to jam in place increases. Conventionally the wedge is driven by a single spring in a large group. The portion of the vertical spring force acting on the damper wedge can be less than 15% of the group total. In the embodiment of FIG. 5*a*, it is 50% of the group total. The wedge angle of wedges 440, 442 is significantly greater than 35 degrees. The use of more springs permit the enclosed angle of the wedge to be significantly larger, in the range of 45 to 60 degrees.

The size of the spring group yields an opening between the vertical columns of side frame 404 of roughly 33 inches. This is relatively large compared to existing spring groups, being more than 25% greater in width. Truck 400 has a correspondingly greater wheelbase length, indicated as WB. WB is advantageously greater than 73 inches, or, taken as a ratio to the track gauge width, and is also advantageously greater than 1.30 time the track gauge width. It is preferably greater than 80 inches, or more than 1.4 times the gauge width, and in one embodiment is greater than 1.5 times the track gauge width, being as great, or greater than, about 86 inches.

Figure 6A:
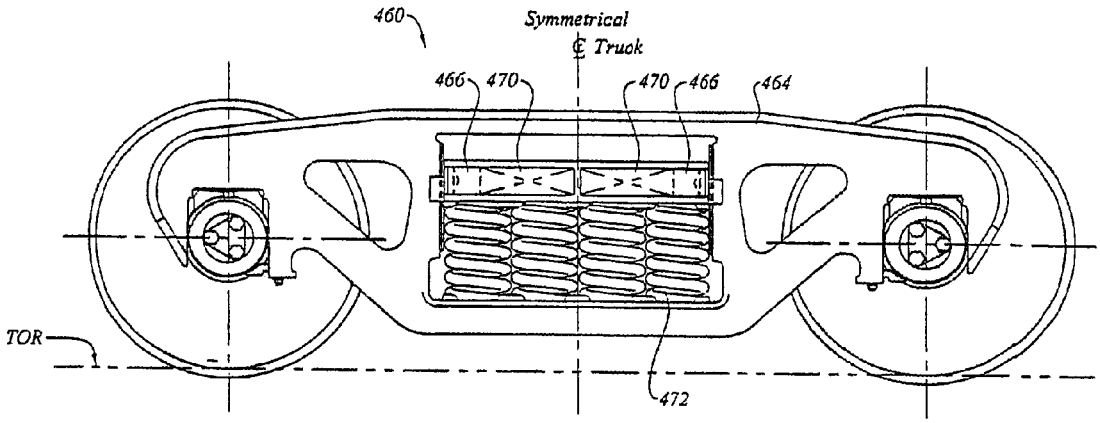
FIG. 6*a* shows a side view of an alternate three piece truck to that of FIG. 5*a;*
Figure 6B:
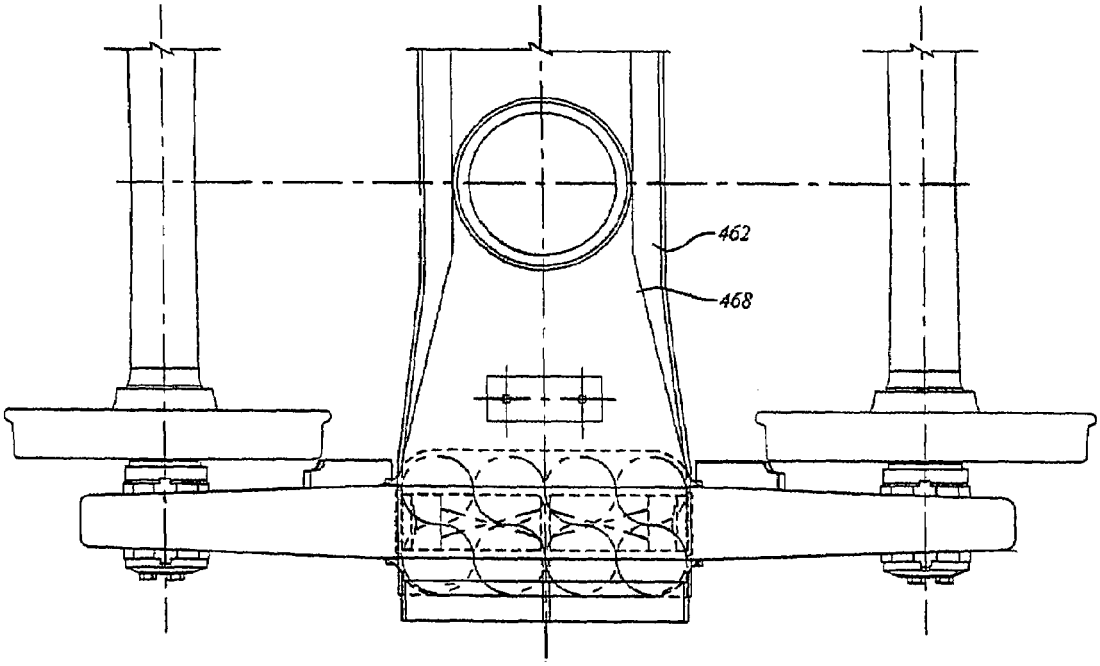
FIG. 6*b* shows a top view of half of the three piece truck of FIG. 6*a*.
Figure 6C:
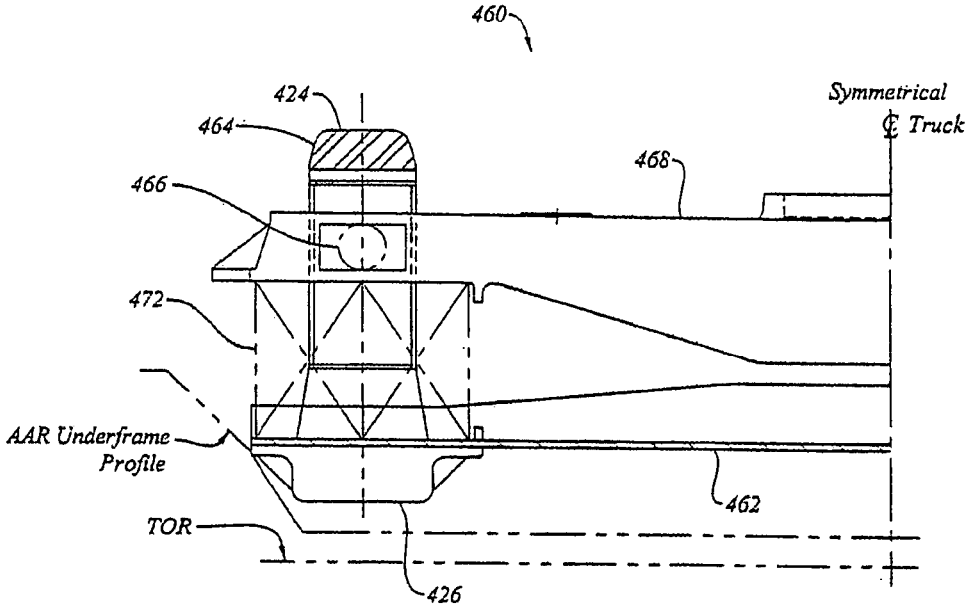
FIG. 6*c* shows a partial section of the three piece truck of FIG. 6*a* taken on '6*c*-6*c*'.

In FIGS. 6*a*, 6*b* and 6*c*, there is an alternate truck embodiment of soft spring rate, long wheelbase three piece truck, identified as 460. Although truck 400 is thought to be preferable, there are a number of alternate possible configurations of truck. Truck 460 is generally similar to truck 400, but differs in having a transom 462 in the form of an upwardly opening channel member bolted between undersides of the lower beam members of the left and right side frames 464 respectively. A transom such as transom 462 increases the rigidity of the truck against parallelogram deformation in hunting. Truck 460 also employs constant force inboard and outboard, fore and aft pairs of friction dampers 466 mounted in the distal ends of truck bolster 468. In this arrangement, springs 470 are mounted horizontally in the distal ends of truck bolster 468 and urge, or bias, each of the friction dampers 466 against the corresponding friction surfaces of the vertical columns of the side frames.

The spring force on friction damper wedges 440 and 442 varies as a function of the vertical displacement of truck bolster 402, since they are driven by the vertical springs of spring group 405. By contrast, the deflection of springs 470 does not depend on vertical compression of the main spring group 472, but rather is a function of an initial pre-load. Although the arrangement of FIGS. 6*a*, 6*b* and 6*c* still provides inboard and outboard dampers and independent springing of the dampers, the embodiment of FIG. 5*a* is preferred.

In the embodiments described above, it is preferred that the spring group be installed without the requirement for pre-compression of the springs. However, where a higher ratio of dead sprung weight to live load is desired, additional ballast can be added up to the limit of the truck capacity with appropriate pre-compression of the springs. It is advantageous for the spring rate of the spring groups be in the range of 6,400 to 10,000 lbs/in per side frame group, or 12,000 to 20,000 lbs/in per truck in vertical bounce.

In the embodiments of FIGS. 1*a*, 1*b*, 2*a*, 2*b*, 3*a* and 3*b*, the ratio of the dead sprung weight, WD, of the rail car unit (being the weight of the car body plus the weight of the truck bolster) without lading to the live load, WL, namely the maximum weight of lading, be at least 1:1. It is advantageous that this ratio WD:WL lie in the range of 1:1 to 10:3. In one embodiment of rail car of FIGS. 1*a*, 1*b*, 2*a*, 2*b*, 3*a* and 3*b* the ratio can be about 1.2:1 It is more advantageous for the ratio to be at least 1.5:1, and preferable that the ratio be greater than 2:1.

The embodiments described have natural vertical bounce frequencies that are less than the 4-6 Hz. range of freight cars more generally. In addition, a softening of the suspension to 3.0 hz would be an improvement, yet the embodiments described herein, whether for individual trucks or for overall car response are also less than 3.0 Hz in the unladen vertical bounce mode. That is, the fully laden natural vertical bounce frequency for one embodiment of rail cars of FIGS. 1*a*, 1*b*, 2*a*, 2*b*, 3*a* and 3*b* is 1.5 Hz or less, with the unladen vertical bounce natural frequency being less than 2.0 Hz, and advantageously less than 1.8 Hz. It is preferred that the natural vertical bounce frequency be in the range of 1.0 Hz to 1.5 Hz. The ratio of the unladen natural frequency to the fully laden natural frequency is less than 1.4:1.0, advantageously less than 1.3:1.0, and even more advantageously, less than 1.25:1.0.

The principles of the present invention are not limited to auto rack rail road cars, but apply to freight cars, and three piece freight car trucks in situations where improved ride quality is desired, typically those involving the transport of relatively high value, low density manufactured goods.

Various embodiments of the invention have now been described in detail. Since changes in and or additions to the above-described best mode may be made without departing from the nature, spirit or scope of the invention, the invention is not to be limited to those details.

What is claimed is:

1. A three piece rail road car truck, the truck having a longitudinal rolling direction, and a transverse direction extending cross-wise to the rolling direction, said truck comprising:

a pair of first and second side frames and a truck bolster defining primary members of said three piece truck, said bolster being resiliently mounted transversely relative to said side frames, said truck being free of a transom;

said side frames each having a side frame window bounded by a pair of first and second side frame columns, a lower member and an upper member;

said first side frame column having a first planar wear plate mounted thereto;

said second side frame column having a second planar wear plate mounted thereto;

said truck bolster having first and second ends;

wheelsets, each said wheelset having an axle having two wheels mounted thereto, and each axle being mounted to said side frames;

first and second spring groups, one of said spring groups being mounted in each of said side frames, each said spring group supporting one of said ends of said bolster within its respective side frame window;

each of said spring groups including coils of springs sitting in a side-by-side grouping, said grouping having four cornermost springs, said cornermost springs including a first inboard corner spring, a second inboard corner spring spaced lengthwise along said side frame from said first inboard corner spring, a first outboard corner spring, a second outboard corner spring spaced lengthwise along said side frame from said first outboard corner spring;

said first outboard corner spring being spaced laterally outboard of said first inboard corner spring;

said second outboard corner spring being spaced laterally outboard of said second inboard corner spring;

first and second damper groups mounted at respective ends of said bolster;

said first damper group including a first damper and a second damper, said first damper being located in the transverse direction inboard of the second damper;

each of said first and second dampers being seated in said first end of said bolster and being independently driven to contact said first wear plate of said first side frame column of said first side frame;

said first damper being mounted over said first inboard corner spring, said second damper being mounted over said first outboard corner spring;

said first inboard corner and first outboard corner springs each having a spring of smaller diameter nested therewithin;

said dampers include angled damper wedges working in correspondingly angled damper pockets, said angled damper wedges having a damper angle of greater than 35 degrees; and said first spring group has a combined vertical spring rate, and substantially more than 15% of that spring rate is applied beneath said first damper group.

2. The three piece rail road car truck of claim 1 wherein said first and second dampers are maintained apart from each other.

3. The three piece rail road car truck of claim 2 wherein a separator web is mounted between said first and second dampers.

4. The three piece rail road car truck of claim 1 wherein third and fourth dampers are also mounted at said first end of said bolster.

5. The three piece rail road car truck of claim 1 wherein said dampers have included damper wedge angles in the range of 45 to 60 degrees.

6. The three piece rail road car truck of claim 1 wherein said angle is greater than 45 degrees.

7. The three piece rail road car truck of claim 1, wherein, when viewed from above, said bolster has a narrow central waist, said ends being wider than said waist.

8. The three piece rail road car truck of claim 1 wherein said side frame window of said first side frame has a window width greater than 75% of 33 inches.

9. The three piece rail road car truck of claim 1 wherein each said spring group has an overall vertical spring rate constant in the range of 6000 lb/in to 10,000 lb/in.

10. A railroad car having the truck of claim 1, wherein:

said railroad car includes a main bolster seated over one of said trucks, and side sills extending along said railroad car, said main bolster extending between said side sills;

said main bolster having a central portion and first and second arms extending to either side thereof;

said first arm has a first portion extending transversely inboard of said first side sill, said first portion including an upwardly and inwardly formed relief; said relief being located above one of said side frames of said truck.

11. A railroad car having the truck of claim 1 wherein:

said railroad car includes a main bolster seated over one of said trucks, and side sills extending along said railroad car, said main bolster extending between said side sills;

said main bolster having a central portion and first and second arms extending to either side thereof;

said first arm has a web and a flange extending over said first side frame of said truck, said flange having an upward deviation therein, said deviation being located over said first side frame.

12. A railroad car having the truck of claim 1 wherein:

said railroad car includes a main bolster seated over one of said trucks, and side sills extending along said railroad car, said main bolster extending between said side sills;

said main bolster having a central portion and first and second arms extending to either side thereof;

said first arm has a web and a flange extending over said first side frames of said truck, said web having a local minimum depth located over said first side frame, and a deeper portion located outboard thereof.

13. A railroad car having the truck of claim 1 wherein:

said railroad car has a main bolster mounted over said truck, said main bolster having carve-outs formed therein over said side frames; and each said spring group having a vertical spring rate between 6,400 and 10,000 lb/in.

14. A railroad car having the truck of claim 1, wherein:

said railroad car has a cross-wise extending main bolster located over said truck, and lengthwise extending side sills running along said railroad car outboard of said bolster; and said main bolster has carve outs formed over said side frames.

15. The railroad car of claim 14 wherein said main bolster has a bottom flange, and one of said carve-outs has an upper boundary defined by an upward deviation in said bottom flange.

16. The railroad car of claim 14 wherein said main bolster has a web, and said web is locally shallow at said carve-outs.

17. A three piece rail road car truck, the truck having a longitudinal rolling direction, and a transverse direction extending cross-wise to the rolling direction, said truck comprising:

a pair of first and second side frames and a truck bolster defining primary members of said three piece truck, said bolster being resiliently mounted transversely relative to said side frames, said truck being free of a transom;

said side frames each having a side frame window bounded by a pair of first and second side frame columns, a lower member and an upper member;

said first side frame column having a first planar wear plate mounted thereto;

said second side frame column having a second planar wear plate mounted thereto;

said truck bolster having first and second ends;

wheelsets, each said wheelset having an axle having two wheels mounted thereto, and each axle being mounted to said side frames;

first and second spring groups, one of said first and second spring groups being mounted in each of said side frames, each said spring group supporting one of said ends of said bolster within its respective side frame window;

each of said spring groups having four cornermost springs, said cornermost springs including a first inboard corner spring, a second inboard corner spring spaced lengthwise along said side frame from said first inboard corner spring, a first outboard corner spring, a second outboard corner spring spaced lengthwise along said side frame from said first outboard corner spring;

said first outboard corner spring being spaced laterally outboard of said first inboard corner spring;

said second outboard corner spring being spaced laterally outboard of said second inboard corner spring;

first and second damper groups mounted at respective ends of said bolster;

said first damper group including a first damper and a second damper, said first damper being located in the transverse direction inboard of the second damper;

each of said first and second dampers being seated in said first end of said bolster and being mounted to contact said first wear plate of said first side frame, said first damper being driven by said first inboard corner spring, said second damper being driven by said first outboard corner spring, and each of said first and second dampers being driven independently of the other;

said first inboard corner and first outboard corner springs each having a smaller diameter spring nested therewithin;

said first and second damper groups each include angled damper wedges working in correspondingly angled damper pockets, said angled damper wedges having a damper angle of greater than 35 degrees; and said first spring group has a combined vertical spring rate, and more than 15% of that spring rate is applied beneath said first damper group.

18. The three piece truck of claim 17 wherein said first damper group includes four dampers, each damper being independently spring driven.

19. The three piece truck of claim 18 wherein each damper is driven by a spring having another spring nested therewithin.

20. A three piece rail road car truck, the truck having a longitudinal rolling direction, and a transverse direction extending cross-wise to the rolling direction, said truck comprising:

a pair of first and second side frames and a truck bolster resiliently mounted transversely relative thereto, said truck being free of a transom;

said side frames each having a side frame window bounded by a pair of first and second side frame columns, a lower member and an upper member;

said first side frame column having a first planar wear plate mounted thereto;

said truck bolster having first and second ends;

first and second spring groups, one of said spring groups being mounted in each of said side frames, each said spring group supporting one of said ends of said bolster within its respective side frame window;

first and second damper groups mounted at respective ends of said bolster;

said first damper group including four dampers, said four dampers including a first inboard damper, a second inboard damper, a first outboard damper and a second outboard damper, said four dampers being mounted in a four cornered arrangement in which two of said dampers work between said first end of said bolster and said first side frame column of said first side frame, and two of said dampers work between said first end of said bolster and said second side frame column of said first side frame;

said first spring group having four cornermost springs, said cornermost springs including a first inboard corner spring, a second inboard corner spring spaced lengthwise along said side frame from said first inboard corner spring, a first outboard corner spring, a second outboard corner spring spaced lengthwise along said side frame from said first outboard corner spring;

said first outboard corner spring being spaced laterally outboard of said first inboard corner spring;

said second outboard corner spring being spaced laterally outboard of said second inboard corner spring;

said first inboard damper being driven by said first inboard corner spring;

said second inboard damper being driven by said second inboard corner spring;

said first outboard damper being driven by said first outboard corner spring;

said second outboard damper being driven by said second outboard corner spring;

each of said first inboard and outboard dampers being seated in said first end of said bolster and being independently driven to contact said first wear plate of said first side frame column of said first side frame;

each of said four dampers being independently driven;

each of said four dampers being driven by an outer spring and an inner spring, said inner spring being nested within said outer spring.

21. The rail road car truck of claim 20 wherein said two dampers mounted to work between said first end of said bolster and said first side frame column of said first side frame are mounted in bolster respective pockets that are segregated from each other.

22. The rail road car truck of claim 21 wherein said first side frame column includes said planar wear plate having a surface lying in a plane that extends up and down and cross-wise relative to said side frame, and said two dampers mounted to work between said first end of said bolster and said first side frame column of said first side frame both work against said surface.

23. The rail road car truck of claim 20 wherein each of said dampers includes a damper wedge, the damper wedge having a first face for engaging the respective side frame column, and a second, sloped, face for seating against a similarly inclined face of a bolster pocket of said bolster, having a wedge angle of greater than 35 degrees as measured between the first face and the second, sloped, face.

* * * * *